US009498796B2

(12) United States Patent
Dahl

(10) Patent No.: US 9,498,796 B2
(45) Date of Patent: Nov. 22, 2016

(54) METHOD AND APPARATUS FOR MONITORING WEAR OF AND REPAIRING SHAKER SCREENS

(75) Inventor: Bjorn Dahl, Loen (NO)

(73) Assignee: OPTIPRO AS, Loen (NO)

( * ) Notice: Subject to any disclaimer, the term of this patent is extended or adjusted under 35 U.S.C. 154(b) by 975 days.

(21) Appl. No.: 13/635,789

(22) PCT Filed: Mar. 18, 2011

(86) PCT No.: PCT/NO2011/000094
§ 371 (c)(1),
(2), (4) Date: Sep. 18, 2012

(87) PCT Pub. No.: WO2011/115508
PCT Pub. Date: Sep. 22, 2011

(65) Prior Publication Data

US 2013/0013100 A1 Jan. 10, 2013

Related U.S. Application Data

(60) Provisional application No. 61/315,732, filed on Mar. 19, 2010.

(30) Foreign Application Priority Data

Mar. 19, 2010 (NO) ..... 20100411

(51) Int. Cl.
*B07B 1/46* (2006.01)
*B07B 1/50* (2006.01)
*B08B 3/12* (2006.01)

(52) U.S. Cl.
CPC ..... *B07B 1/46* (2013.01); *B07B 1/4609* (2013.01); *B07B 1/4627* (2013.01); *B07B 1/50* (2013.01); *B08B 3/12* (2013.01)

(58) Field of Classification Search
CPC ..... B07B 1/46; B07B 1/4609; B07B 1/4627; B07B 1/50; B08B 3/12
USPC ..... 134/56 R
See application file for complete search history.

(56) References Cited

U.S. PATENT DOCUMENTS

2003/0095250 A1* 5/2003 Kitagawa ..... B23P 6/007 356/237.1
2006/0108113 A1* 5/2006 Scott ..... B01D 33/0376 166/255.1
2008/0289971 A1* 11/2008 Shigihara ..... A61L 2/025 205/687

FOREIGN PATENT DOCUMENTS

| | | | |
|---|---|---|---|
| DE | 24 43 548 | A1 | 3/1976 |
| EP | 1 312 438 | A1 | 5/2003 |
| JP | 6-023324 | A | 2/1994 |
| JP | 2002-350353 | A | 12/2002 |
| WO | WO 2006/112728 | A1 | 10/2006 |

OTHER PUBLICATIONS

JP2002-350353 English Translation, accessed on Jul. 2015.*

* cited by examiner

*Primary Examiner* — Michael Barr
*Assistant Examiner* — Levon J Shahinian
(74) *Attorney, Agent, or Firm* — Birch, Stewart, Kolasch & Birch, LLP

(57) ABSTRACT

The invention is an apparatus for cleansing and monitoring wear of screen cloths (1) comprising: a) a feeding device (100) for used or contaminated screen cloths (1) to b) a cleansing unit (4) arranged for receiving and cleansing said screen cloth (1), c) a preparation unit (140) arranged for preparing said screen cloth (1) for optical inspection in d) an optical inspection station (120) arranged to identify one or more damaged portions (6) of said screen cloth (1) and with a registering device for registering positions (7) for said damaged portions (6), e) a measuring device (62) for measuring and registering an extent of said one or more damaged portions (6) extent and degree of damage, f) a repair unit (70) arranged for mending one or more of said damaged portions (6), g) a feeding out unit (200) for feeding out said repaired screen cloth (1).

17 Claims, 24 Drawing Sheets

100: magazine
102: gate

SECTION A-A

SECTION A-A

METHOD AND APPARATUS FOR MONITORING WEAR OF AND REPAIRING SHAKER SCREENS

This application is the National Phase of PCT/NO2011/000094 filed on Mar. 18, 2011, which claims priority under 35 U.S.C. 119(e) to the U.S. Provisional Application No. 61/315,732 filed on Mar. 19, 2010 and under 35 U.S.C. 119(a) to Patent Application No. 20100411 filed in Norway on Mar. 19, 2010, all which are hereby expressly incorporated by reference into the present application.

INTRODUCTION

The present invention relates to drilling mud/particle separator screens or so-called "shaker screens" used during drilling boreholes for petroleum exploitation. More specifically, the invention relates to a method and a device for cleansing a shaker screen used in a drilling mud/particle separator, inspecting the shaker screen, identifying and registering significant wear on the shaker screen and repairing the shaker screen if significant wear is present, and returning the shaker screen for further use in borehole drilling.

Drilling of petroleum wells is conducted in that the drilling string is hollow and transports drilling liquid down to or in to a drill bit with nozzles. The drilling fluid returns with drilled out formation rock mass in the form of cuttings, rock particles, sand and metal particles back to the surface. The drilling liquid has high density and may be tixotropic or not, in order to bring along particles and cuttings back via the annulus and out of the borehole. The drilling liquid as such is an expensive liquid, it shall to a smallest degree possible be released, and shall to a largest degree possible be recuperated. On the surface the drilling liquid and the cuttings via the primary separator plant normally comprising vibrating or rotating screen cloths.

BACKGROUND ART

Vibrating screen cloths (1) are used in so-called "shakers" for catching and vibrating out laterally that portion of the returning drilling mud or drilling liquid which is constituted by cuttings, sand and metal particles, and letting the drilling mud as such pass filtered through the screen cloth. The drilling mud is led over a series of one or more screen cloths (1), the coarser first, which removes the coarser particles, and later over finer and still finer screen cloths (1). Examples of such screen cloths arranged in frames are shown in FIG. 1.

The entire screen assembly is vibrated in order to make drill cuttings and particles of all sizes to migrate out across the edge of the shaker screen frame so as for the drilling liquids liquid fraction and finer particles, below the shaker screen's mesh size will pass through the screen cloth. There are also screen cloths (1) arranged as an endless band which are arranged for rotating slowly. A shaker screen may comprise a rectangular main frame (2) of about 1×1 m2 and an example is shown in that the main frame may have 10 rows each of 20 rectangular oblong cell frames (22) each supporting its portion of a screen cloth. Most shaker screen frames (2) comprise an upper screen cloth (1) with the desired mesh size, e.g. from 2500 μm (2.5 mm) for the very coarse screen, and down to 20 μm (0.020 mm), all with a backing of a support cloth with mesh size of between 2500 micrometers (2.5 mm) or 2000 μm (2.0 mm) or even 1000 micron (1.0 mm) which are all rather rough and durable. The screen cloth (1) and the support cloth (11) may be fixed to the cell frames (22) by means of adhesives or hardening cement mass so as for the screen cloth and the support cloth not to mutually vibrate and grind and thus to prevent that the screen cloth from be worn over the cell frame, and further prevent that the support cloth from being worn against the cell frame.

The so-called "cut point" of the screen cloth is defined by the size of the particles which have a given probability for being removed in a filter. Usually cut points may be indicated such as "D50 500" and "D90 500" defining 50% and 90% probabilities of being removed for particles of a given size, here 500 gym. For particles larger than the indicated "cut point" the probability for the particle to be sorted out is larger. For particles os a size less than the indicated "cut point" the probability is larger to pass through with the mud.

Problems Related to the Background Art

A screen cloth initially has a given "cut point" which indicates the mesh size distribution of the apertures of the screen cloth, and indirectly indicates which size of particle sized which may pass through the apertures of the given mesh size distribution. The particle size distribution (PSD) affects the drilling liquid's properties and has an influence for example with regard to how far one may drill with the different borehole diameters, related to, among other factors, liquid pressure and resistance forces on the drill string such as torque. An article in the publication of the Society of Petroleum Exploration, SPE103934 "Successful Drilling of Oil and Gas Wells by Optimal Drilling Fluid Solids Control—A Practical and Theoretical Evaluation", by B. Dahl, A. Saasen and T. H. Omland, describes disadvantages of wear of screen cloths.

A significant problem is that the screen cloth, which shall only let through a desired particle size, is worn and holes formed, and thus the screen cloth lets through particles as coarse as will be let through the support cloth, which in this example may be a standard mesh of 1000 gm. Thus in the returning drilling liquid the desired particle size distribution and the desired maximum particle size for the further drilling operation is not actually achieved. This is a known problem and the drilling programme is set up with the limitation which one knows in advance will come which are incurred by the particle size distribution becomes wrong, that is, too coarse due to open holes (h) in lesser or larger proportions in the screen cloths. This incurs that the drilling process is not as good as would otherwise have resulted if the particle size distribution according to the filters used and their nominal values were actually achieved.

The screen cloths' properties throughout the drilling process according to current practice are not registered. Thus the actual temporal development of the cut point of the screen cloth is unknown, and thus also not the quality of the primary separation of the drilling liquid. As an example of through flux by different cut point sizes one may envisage a screen cloth with a cut point of D50 74 μm with a backing of coarser support cloth of D50 1300 μm, such as illustrated in FIG. 3*b*. The maximum particle size which is allowed to pass through the backing cloth (11) has a volume which is about 13 003 divided by 743 which is about 5400 times larger than the particle size which should be allowed to pass through the screen cloth (1). A hole in the screen cloth resulting in that only the backing cloth (11) remains in the damaged part would incur not only that larger particles flow through than what the screen cloth nominally should stop, also a larger liquid voulume will flow through the shaker screen frame, incurring in total that the amount of the undesired particle sizes increases far more than the area proportion of the damaged screen cloth as such of the shaker screen frame.

In summary, the above problems incurred damaged screen cloth in relation to the quality of the resulting drilling mud, particles of too large size are allowed through the damaged shaker screen. Further, the amount of liquid containing too large particle size distributions is larger in proportion than the proportion of damaged screen cloth of the shaker screen.

Condition check of screen cloths may be carried out by analysing a fluid sample of the filtered drilling fluid as described in WO 2006/112728 A1. WO 2006/112728 A1 also describes an apparatus comprising a pump for drawing a drilling fluid sample from the bottom of the tray of the vibration screen into the apparatus, a filter for filtering the drilling fluid sample and a pressure gauge for measuring the pressure difference across the filter.

Another significant problem in that holes are formed in the screen cloth is, that if the screen cloth by a given number of defect cells have open holes, the shaker screen frame must be disposed of and replaced. A shaker screen on a frame costs about 800 US$ and may be consumed in large numbers during a drilling operation of one well. It is difficult to repair a shaker screen on the drilling location if the shaker screen within an entire cell is torn up, but small holes which comprise less than the size of one cell, may be sealed with glue or flexible cement and thus prevent further damage. However, according to the knowledge of the inventor, no system exists which systematically handles problems related to open holes in screen cloths, or any apparatus for automatically repairing screen cloth damages, nor any systematic method for registering the individual histories of used screen cloths during one or more drilling operations. Repair of screen cloths according to present practice is done to a varying degree on the drilling location by use of particularly adapted plugs, glue (single and composite), or silicone based flexible mass. The mending task may constitute a health risk to the operator. The excess man hours required while drilling the larger borehole dimensions such as 24 inches and 17.5 inches may be between 4 and 8 hours in order to keep pace with the development of screen wear while drilling about 3 m3 of rock mass volume per used shaker screen.

The upstream face of the screen cloth (1) is worn due to the impacting or migration of cuttings and particles, but also the downstream face of the screen cloth (1) is worn. The downstream face is worn due to grinding by particles but also due to grinding against the support screen (11) within the cell frames (22) which is vibrated against each other. Empirically one knows that the screen cloth takes place from both sides of the screen cloth (1) both in that a wear by particles occurs on the free upper surface of the screen cloth (1) and due to wear from the support cloth (11) or the frame cell's (22) sub-frame (23) against the underside of the screen cloth's surface, until one or more wires in the screen cloth (1) breaks.

JP2002-350353A describes an inspection device capable of observing and inspecting a screen mesh with little man power, more specifically a microcomputer drives an XY stage to move a screen mesh by one screen distance of a CCD camera and outputs a processing start signal toward an image processing device. An image of the screen mesh obtained from the CCD camera is sent to the image-processing device. The device counts the size of each opening area and the number of the mesh included in a screen and calculates the standard deviation of the opening areas using a statistical technique.

SHORT SUMMARY OF THE INVENTION

In one aspect, the invention is a method for monitoring and maintenance of wear of shale shaker filter screen frames (2) with screen cloths (1) characterized by the steps of:

a) providing a used or drilling liquid contaminated filter screen frame (2) screen cloth (1) to a filter screen frame magazine (100), b) using a movable main manipulator element (115) engaging said filter screen frame (2) in said magazine (100), feeding forward said filter screen (2) to a cleansing unit (4) and cleansing said filter screen frame (2) with said screen cloth (1), c) the manipulator element (115) moving said filter screen frame (2) to a drying unit (140) and drying said filter screen frame (2), d) the manipulator element (115) moving said filter screen frame (2) to an optical inspection station (120) and inspecting optically said screen cloth (1) and using an algorithm in a computer identifying damaged portions (6) of said screen cloth (1) and registering said damage portions' (6) position (7) in a computer memory (9), e) determining in said algorithm said damaged portions' (6) degree of wear or damage and determining whether said worn or damaged portions (6) qualify for being repaired or replaced, f) the manipulator element (115) moving said filter screen frame (2) to a repair station (70) with a repair manipulator (72) repairing or replacing said damaged portions (6) qualified for being repaired or replaced with replacement portions of screen cloth (1), g) moving the so repaired filter screen frame (2) back to said magazine (100).

In another aspect, corresponding to the first aspect, the invention is an apparatus for monitoring and maintenance of wear of shaker screen frames (2) with screen cloths (1), characterized by:

a) a magazine (100) for receiving one or more contaminated filter screen frames (2), b) a movable main manipulator element (115) arranged for engaging said filter screen frame (2) in said magazine (100), and further arranged for feeding forward said filter screen (2) to a cleansing unit (4) to a drying unit (140) to an optical inspecting station (120), to a prepair unit (70) and back to said magazine (100)

c) a drying unit (140) arranged for receiving said filter screen frame (2) for drying said filter screen frame (2), d) an optical inspection station (120) for receiving said filter screen frame (2) arranged for optically imaging said screen cloth (1) and using an algorithm in a computer for identifying damaged portions (6) of said screen cloth (1) and for registering said damaged portions' (6) position (7) in a computer memory (9), e) an algorithm for determining said damaged portions' (6) degree of wear or damage and for determining whether said worn or damaged portions (6) qualify for being repaired or replaced, f) a repair station (70) for receiving said filter screen frame (2) provided with a repair manipulator (72) for repairing or replacing said damaged portions (6) qualified for being repaired or replaced with replacement portions of screen cloth (1), g) said main manipulator element (115) arranged for moving the repaired filter screen frame (2) back to said magazine (1.00).

In an advantageous embodiment of the invention the apparatus is provided with replacement screen plugs (8) for replacing said damaged portions (6) qualified for being replaced. Such screen plugs significantly facilitate the repair of the filter screen frames.

SHORT FIGURE CAPTIONS

Screen cloths, problems related to such screen cloths and their wear, and embodiments of the invention as such are illustrated in the attached drawings. The drawings are meant to illustrate the invention but not to limit the invention.

FIG. 1 shows photographic images of different kinds of stored so called shaker screens for use in vibration separators. Crude screens (top screens) are shown to the left, and so-called primary screens or screen cloths (1) in frames are shown to the right. Such a frame may comprise 10×20 rectangular cells. The cells may also have other shapes such as hexagonal. FIG. 1*b* illustrates background art with a screen frame with a screen cloth, here shown with rectangular and alternative hexagonal cells. FIGS. 1*c* illustrates a background art so-called pyramid screen. FIG. 1*d* shows a hook strip screen with rectangular cells that may be made in epoxy or similar material, or an extensive screen cloth without subdivision into cells. A detail is shown of the hook strip edge. FIG. 1*e, f, g*, and *h* illustrate flat frame screen, convex frame screen, concave frame screen, and rotating screen for use in separator machines in primary separation plants.

FIG. 2 is a photographic image of a screen cloth (1) in a frame (2) in which the screen cloth in about 40 of the 200 cells is entirely or partially damaged such that the screen cloth (1) with the frame (2) is defect and must be disposed of.

Figure 3:
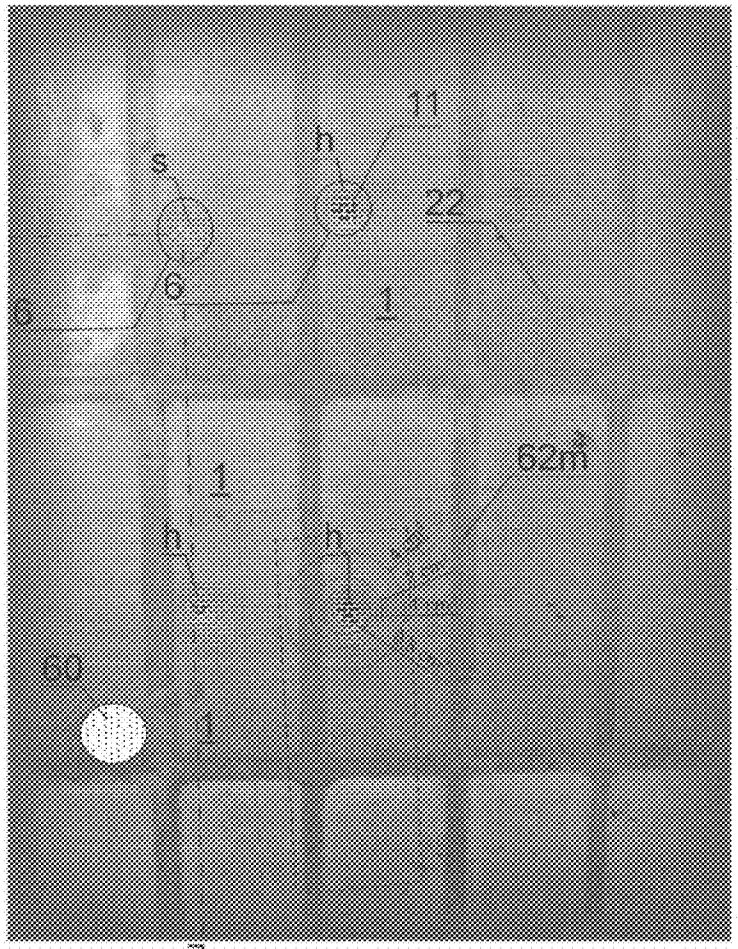
FIG. 3 is a photographic close-up image of cell frames (22) in a generally intact screen cloth (1) under good particle control, so called "solids control", which some wear portions (s) and open wear holes (h) and a repaired portion (60), and a hole template (62*m*) for manual use.
Figure 2:
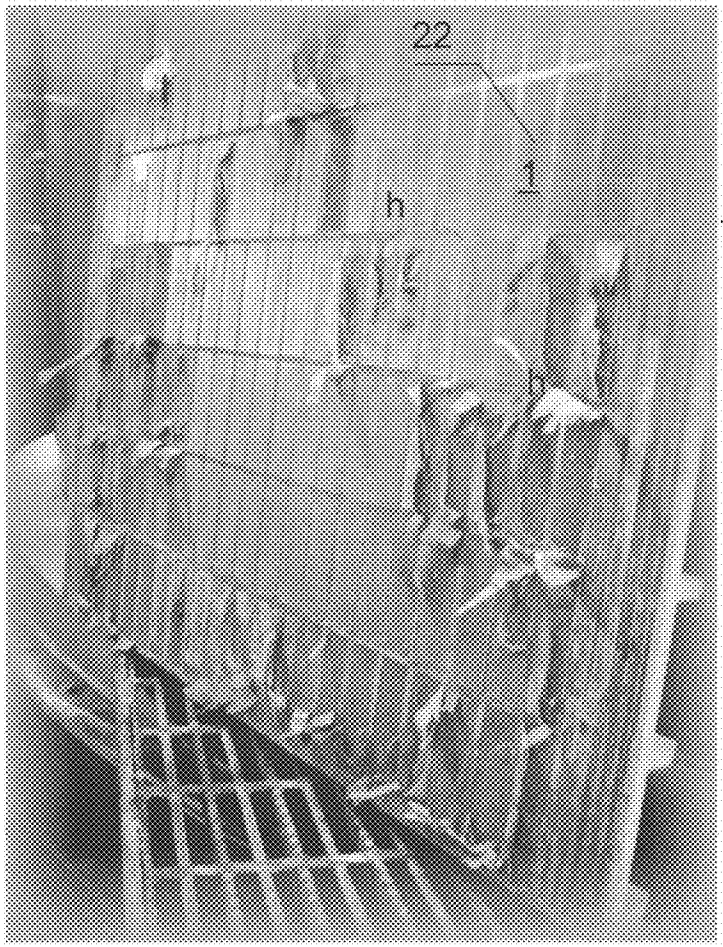
Figure 3B:
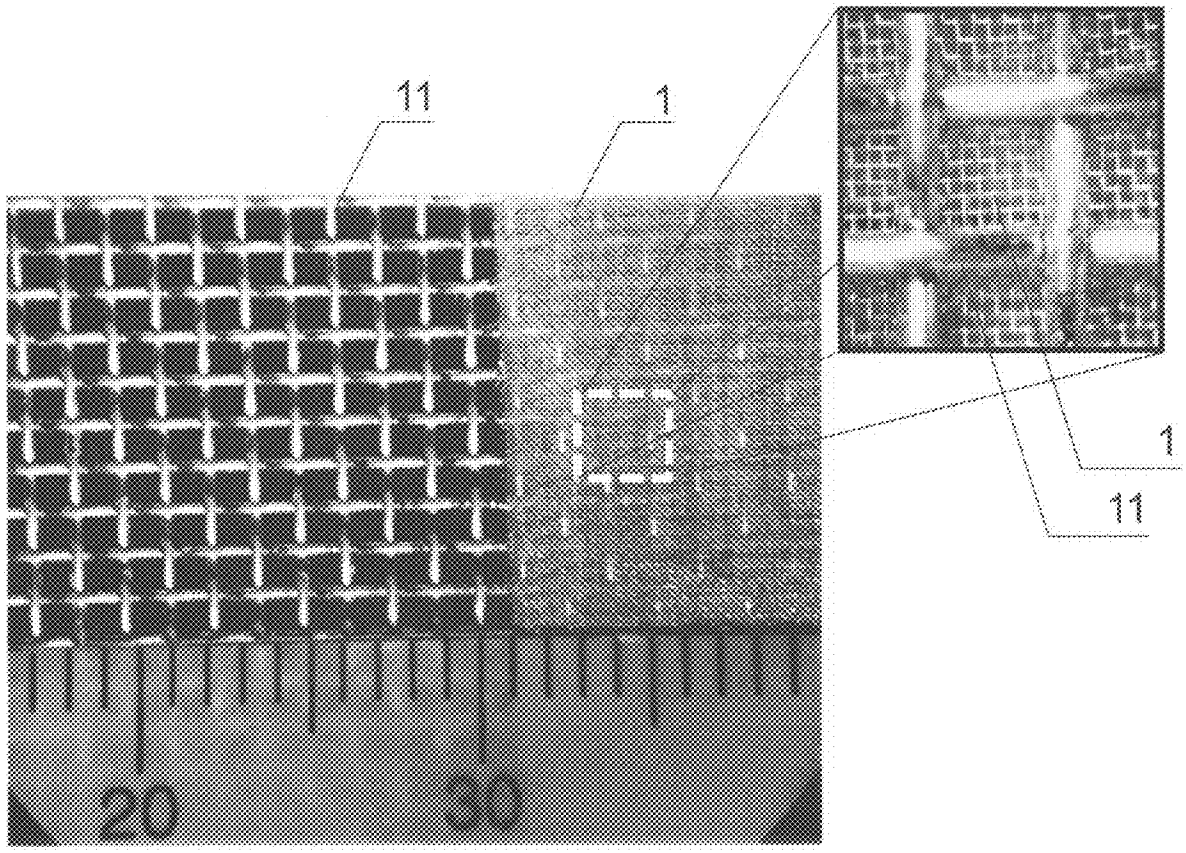

FIG. 3*b* shows close-up images of support cloth (11) and screen cloth (1) for indicating the reduction of the property of being able to separate out small particles which will be incurred by an open hole in the screen cloth.

Figure 4:
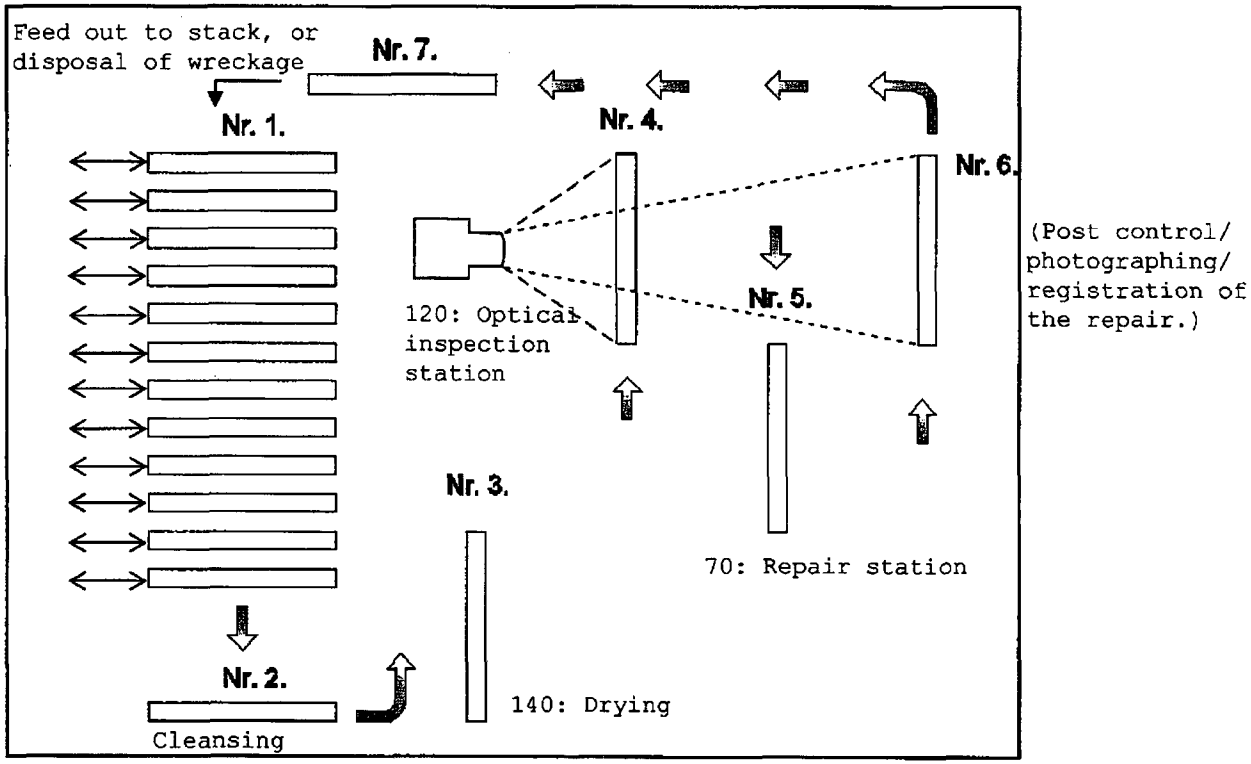

FIG. 4 is a rough illustration of the general process according to the invention for feeding in used, mud contaminated screen cloth frames (1, 2), cleansing the screen cloth, inspecting the screen cloth for wear and possible damages, registering the damages and the wear state of the screen cloth, repairing registered damages of the screen cloth, checking and verifying the repairs, and feeding out the intact or repaired, registered screen cloth frame (l, 2). Repair may be conducted by exchanging part of damaged screen cloth with new screen cloth in part of or entire cell frames (22). In an embodiment of the invention entire screen plugs (8) are exchanged in order to repair the shaker screen frame (2).

Figure 5:
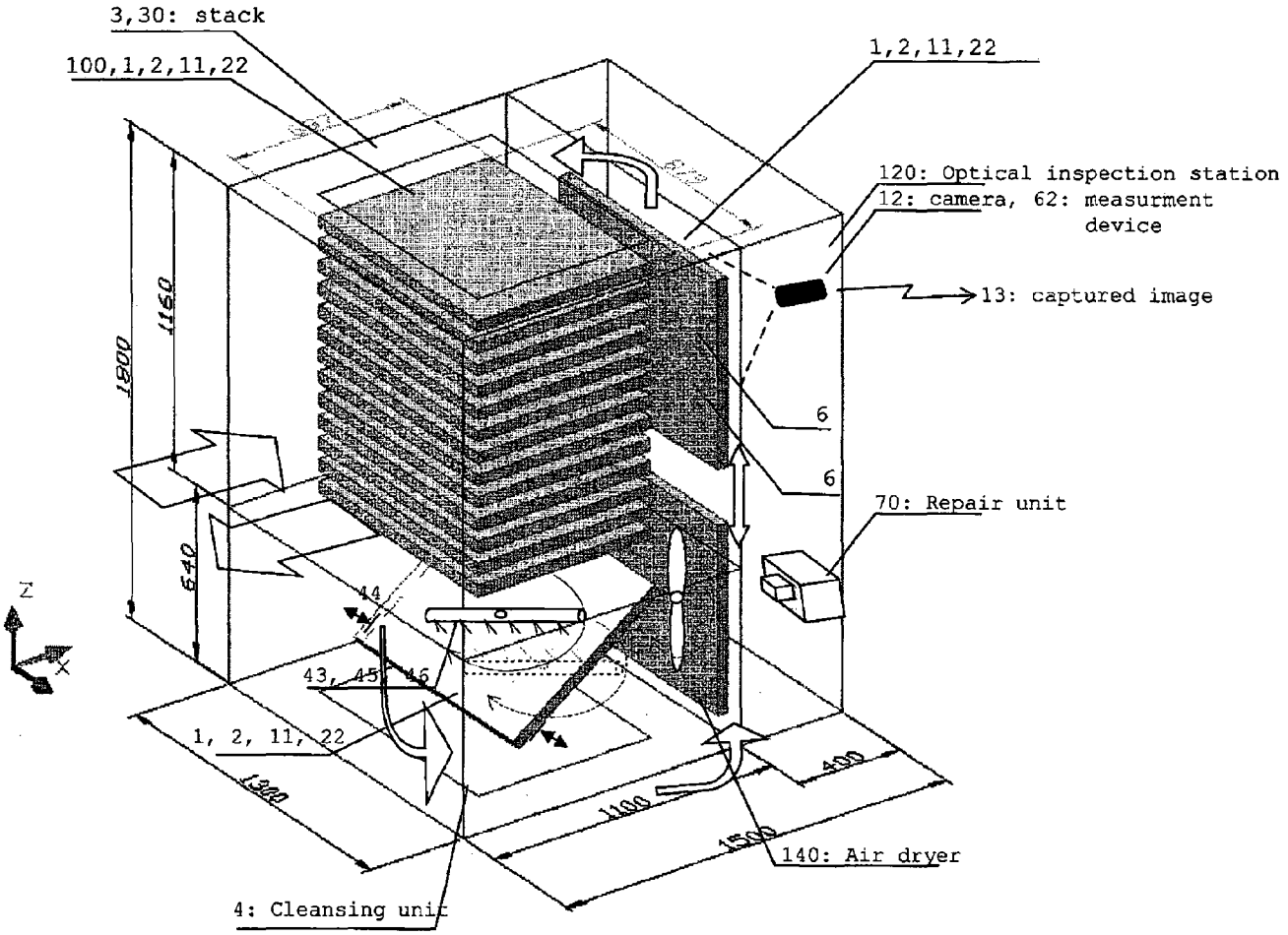
Figure 6:
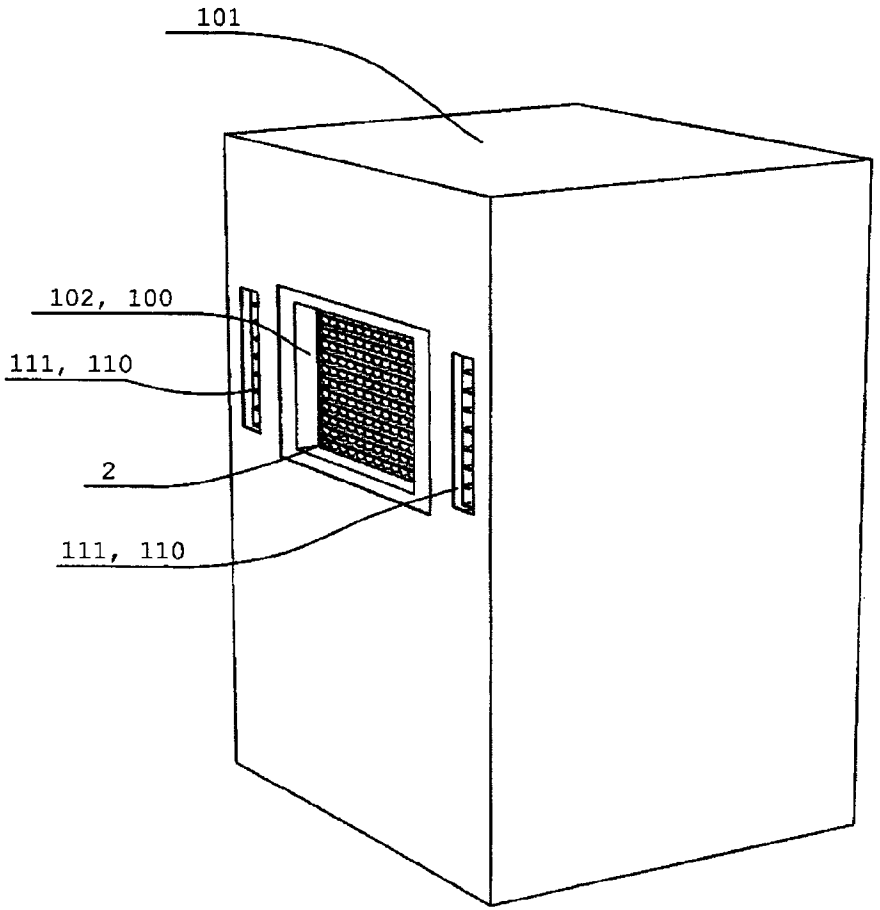

FIG. 5 is a rough overview of an embodiment of the apparatus of the invention for feeding, cleansing, inspecting, registering, repairing, controlling and feeding out of screen cloths (1). FIG. 6 is an isometric view of an embodiment of the invention showing the apparatus' cabinet with a front feeding gate to the magazine for shaker screens, and vertical slots to the sides of the front feeding gate, said slots arranged for new and used screen plugs used during repair of shaker screens.

Figure 7:
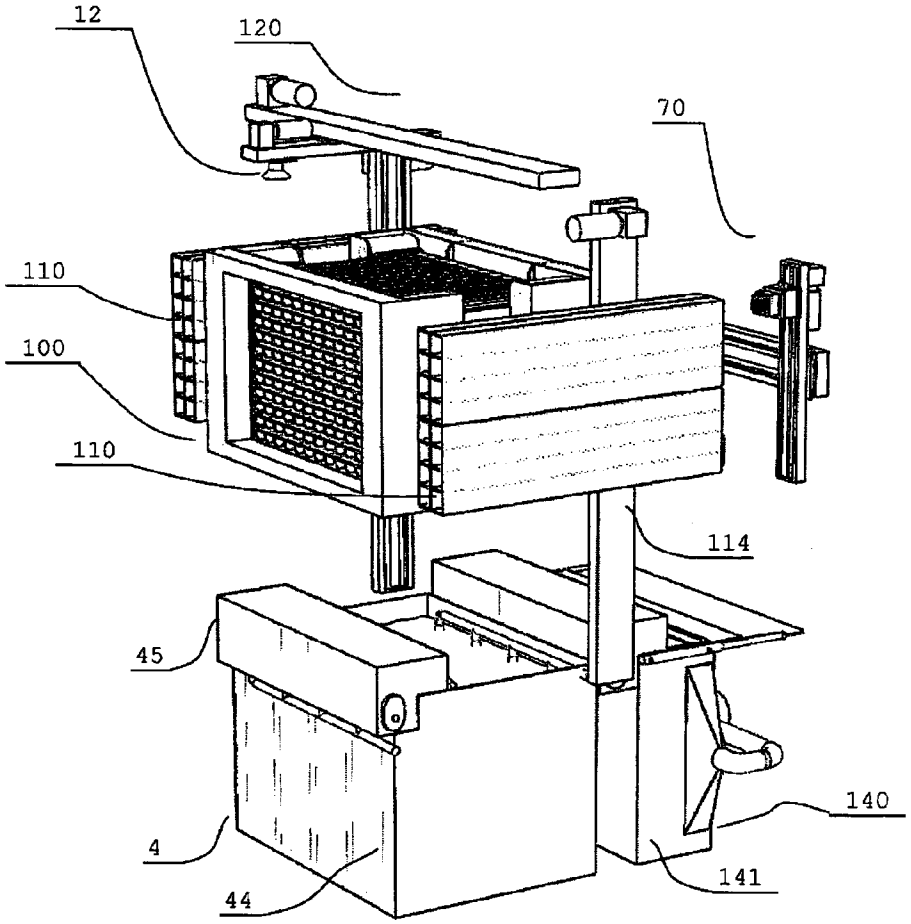

FIG. 7 is a similar isometric view as in FIG. 6 with the cabinet panels removed, showing a magazine main stack 3 for shale shaker filter screen frames (2), a cleansing unit (4), an air dryer unit (140), an optical inspection station (120) on top, and a shaker screen repair unit (70) at the rear part of the apparatus of the invention.

Figure 8:
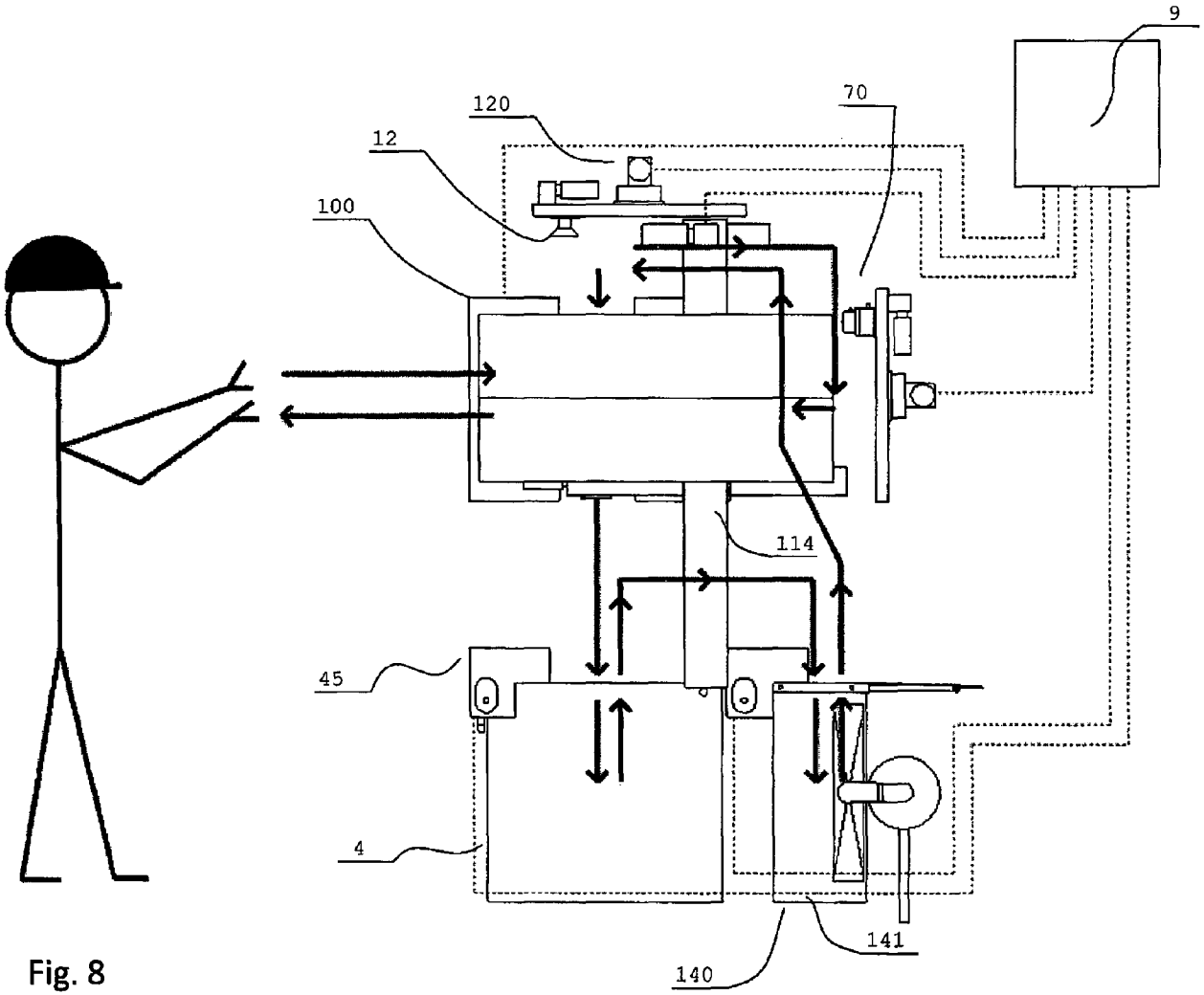

FIG. 8 is a simplified side elevation view of the apparatus of the invention illustrating the path of the shale shaker filter screen frame through the entire apparatus. FIG. 9A is a side view illustration showing a section plane through the magazine (100).

Figure 9B:
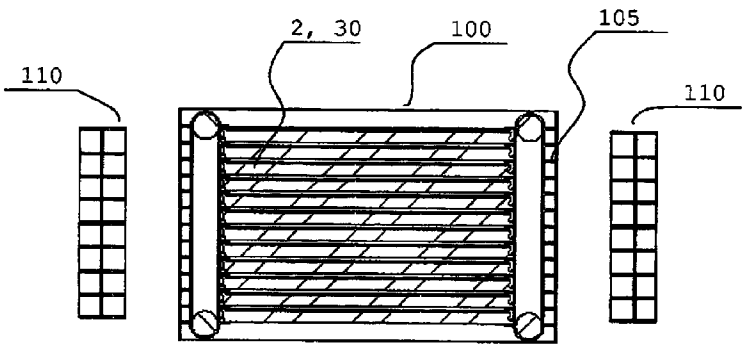
Figure 9B:
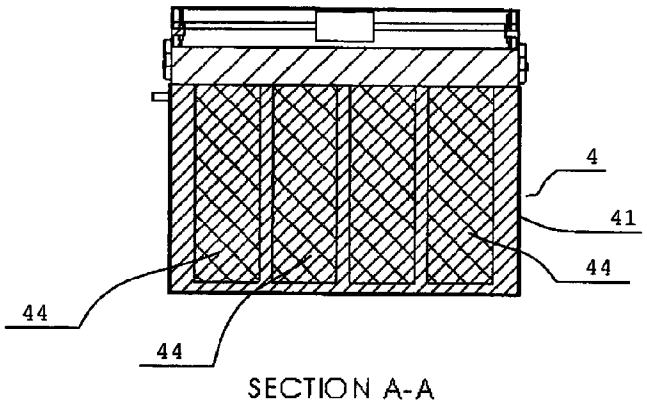
Figure 9A:
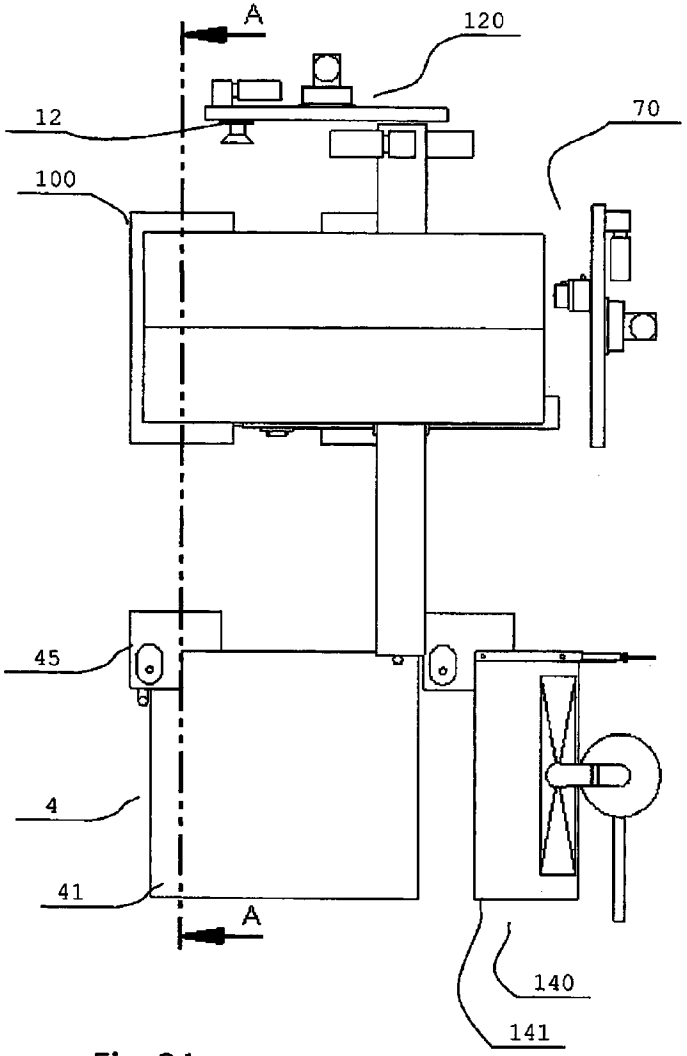

FIG. 9B shows the section indicated in FIG. 9A with an elevator conveyor belt to either sides of the magazine and with filter screen frames. To the right and left side of the magazine (100) are arranged vertical arrays of screen plug magazines for new and used screen plugs for the shaker screens.

Figures 10A, 10B:
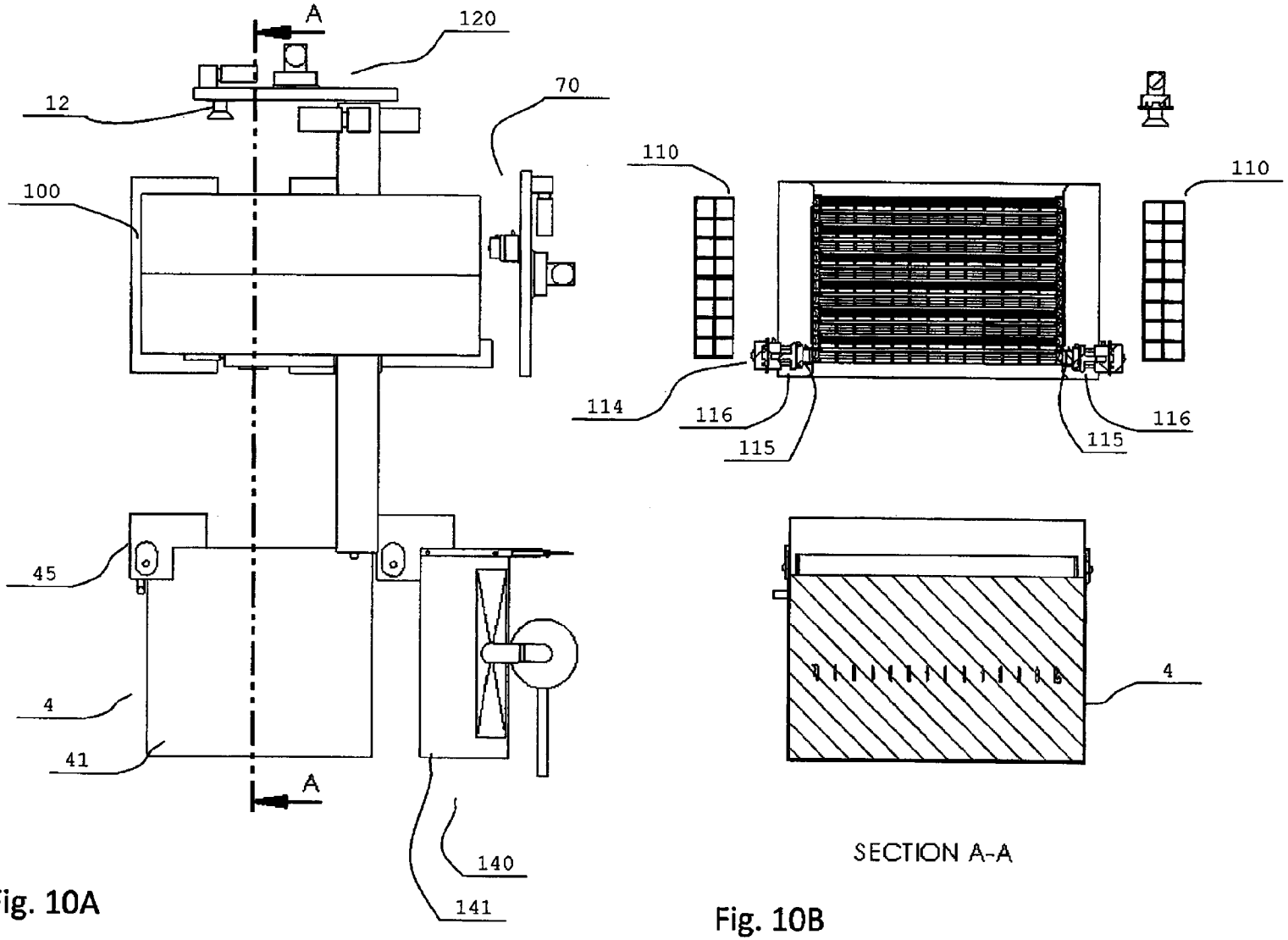

FIG. 10A shows a side view illustration of the apparatus with a section plane through the middle of the magazine, between the elevator conveyour belts.

FIG. 10B is a section view of the section indicated in FIG. 10A showing the main manipulator element ( ) in level with the lower of the stacked filter screen frames and in position to be displaced horizontally to grip that lower shaker screen frame.

Figure 11:
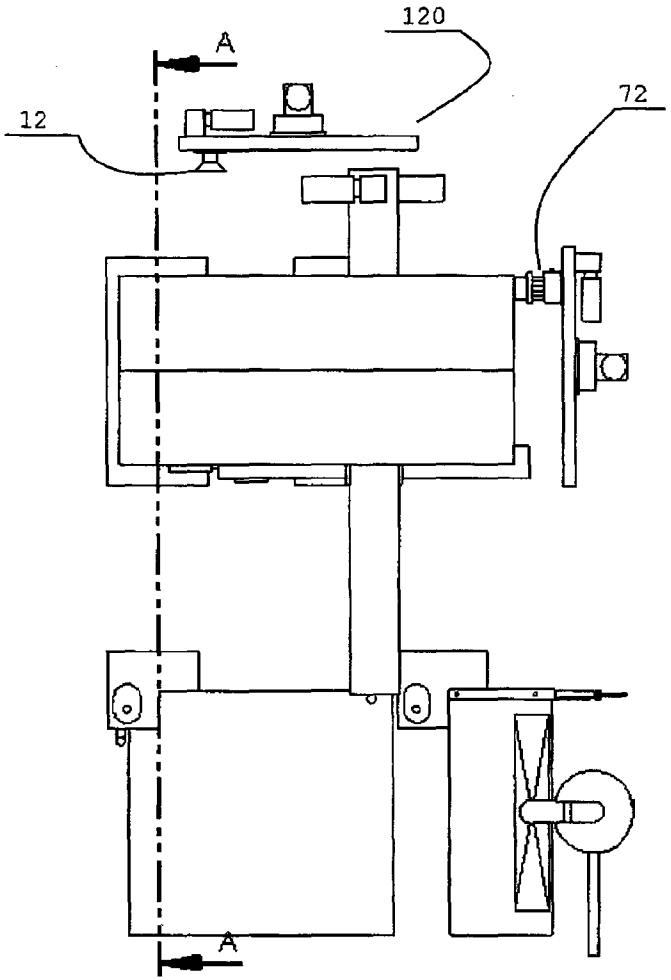

FIG. 11 is a side elevation simplified view of the apparatus of an embodiment of the invention, indicating a vertical section through the fore elevator belts.

Figure 12:
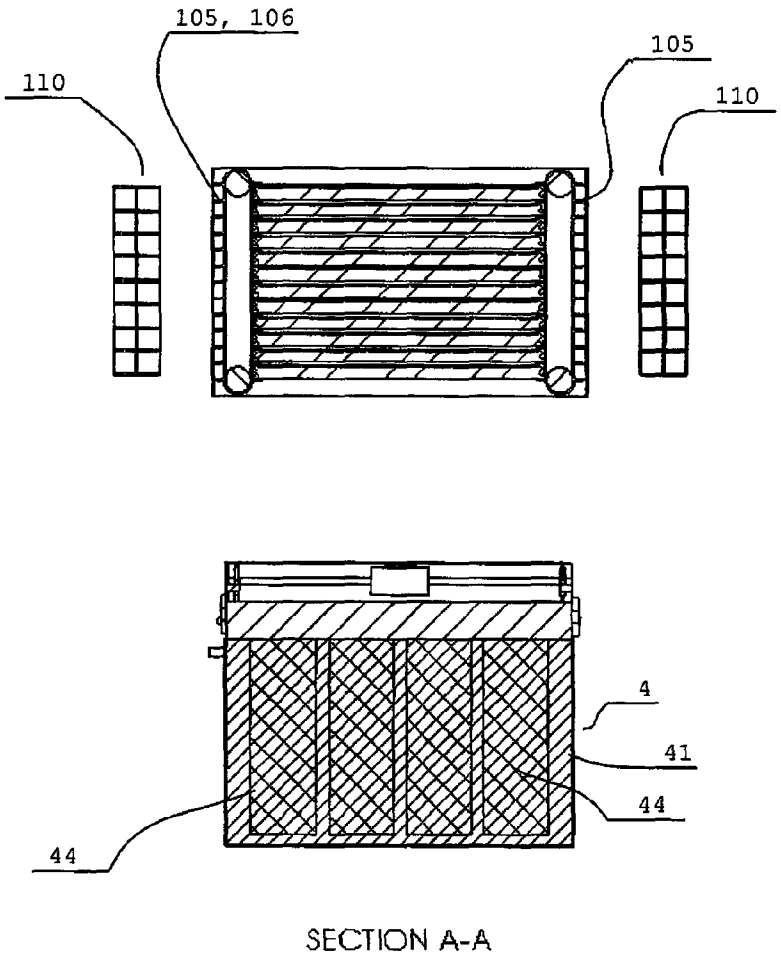

FIG. 12 is the section indicated in FIG. 11, with the elevator conveyor belt an the main magazine and the screen plug magazines shown in the upper part.

Figure 13:
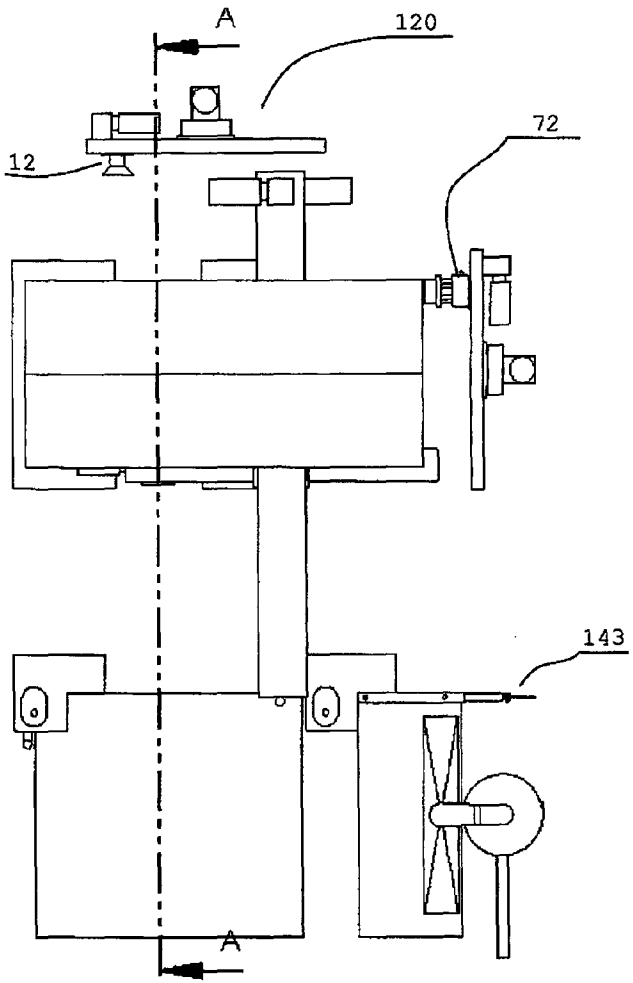

FIG. 13 is a side elevation simplified view of the apparatus of an embodiment similar to FIG. 11 but with the section plane made vertically between the conveyor belts of the elevator.

Figure 14:
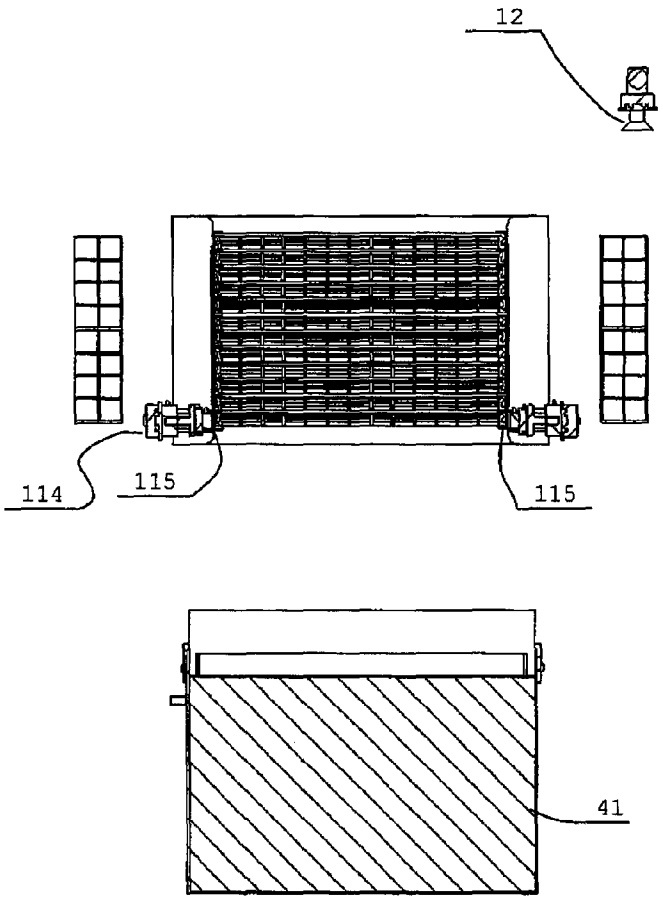

FIG. 14 shows the section indicated in FIG. 13 wherein is illustrated in the upper part of the section the main manipulator elements extended onto the lower filter screen frame of the magazine. The manipulator element is ready to move the filter screen frame down to the receptacle of the cleansing unit.

Figure 15:
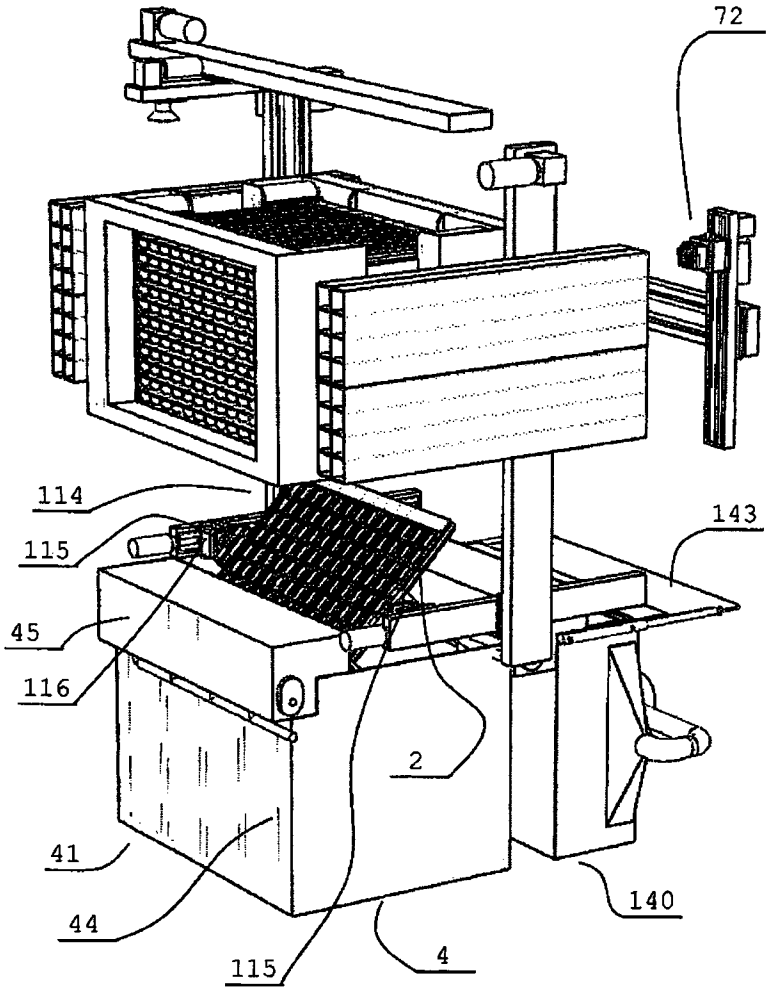

FIG. 15 is an isometric view of the apparatus showing the situation in which the main manipulator elements are about to deliver the filter screen frame to the receptacle of the cleansing unit.

Figure 16:
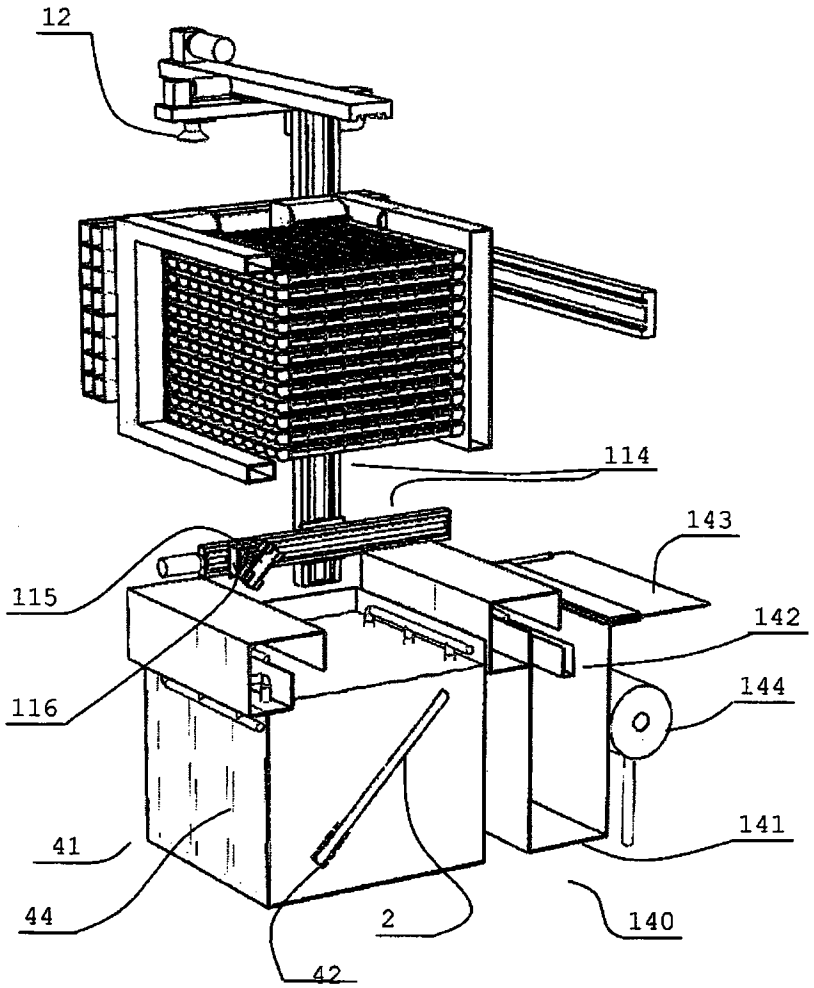

FIG. 16 is a part isometric view in the same perspective as FIG. 15, part isometric vertical section through the magazine (100), the cleansing unit (4) with the submerged filter screen frame (2) subject to ultrasound cleansing from the submerged ultrasound elements, and also a section through the drying unit's (140) dryer cabinet with the vertically displaceable dryer receptacle in an upper position ready for receiving the cleansed filter screen frame (2) when finished in the cleansing bath and forwarded by the cleansing unit's elevator receptacle in cooperation with the main manipulator elements.

Figure 17:
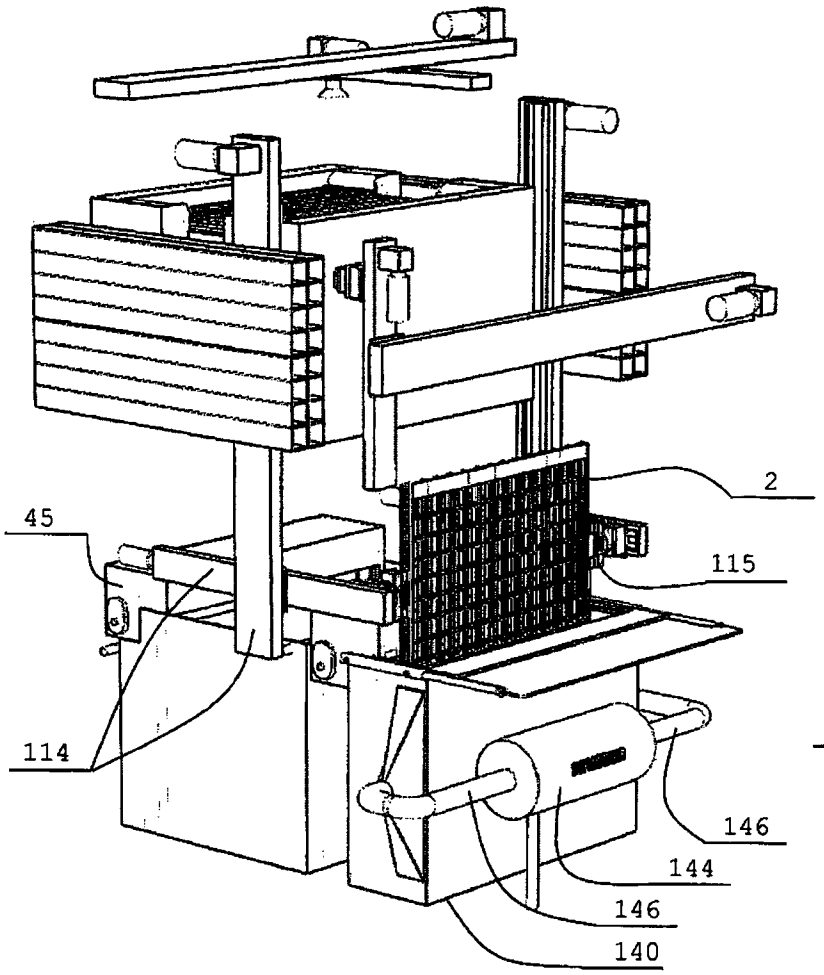

FIG. 17 is an isometric view showing the side and rear parts of an embodiment of the invention. In the lower rear part is shown the dryer unit with the air pump and air piping to and from the drying cabinet. Above the drying unit is shown the rear of the repair unit with the mobile repair manipulator in a laterally displaced position behind the screen plug magazine in order to allow for free movement of the filter screen frame (2).

Figure 18:
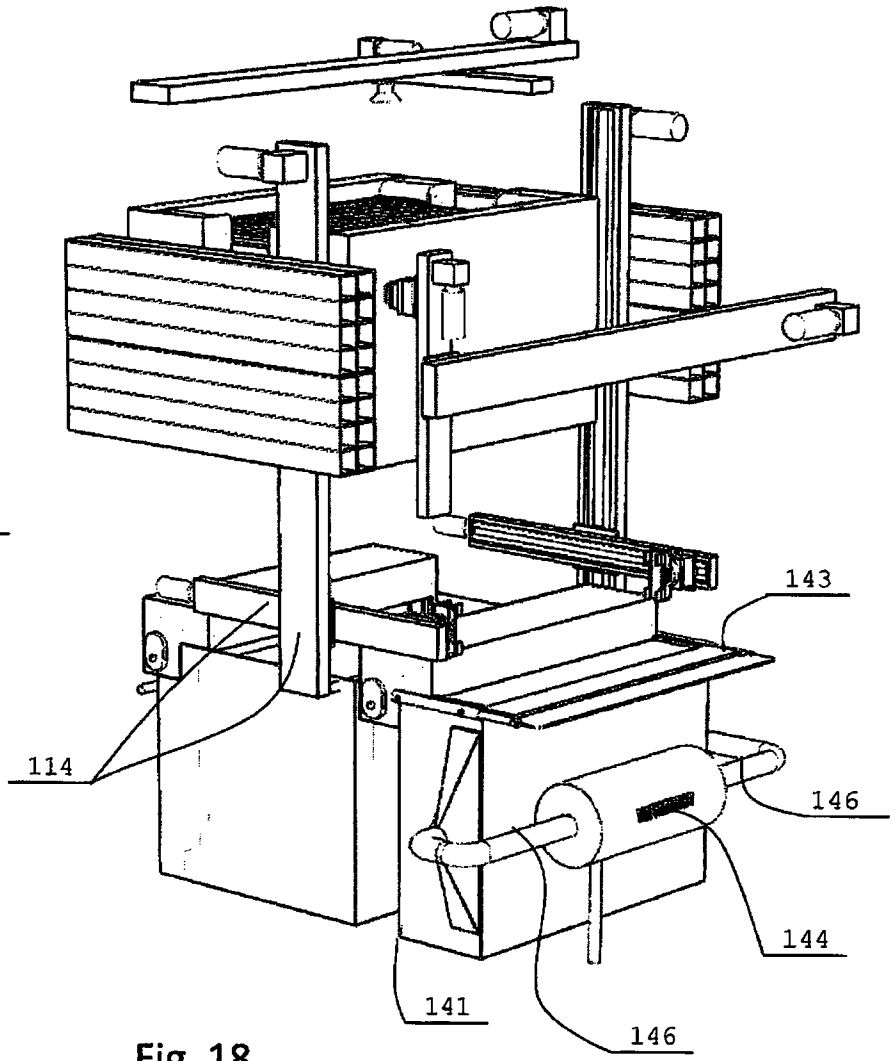

FIG. 18 illustrates the subsequent situation in which the manipulator unit has released from the filter screen frame (2), the frame receptacle with the filter screen frame (2) has been lowered into the drying cabinet, and the lid is closing.

Figure 19:
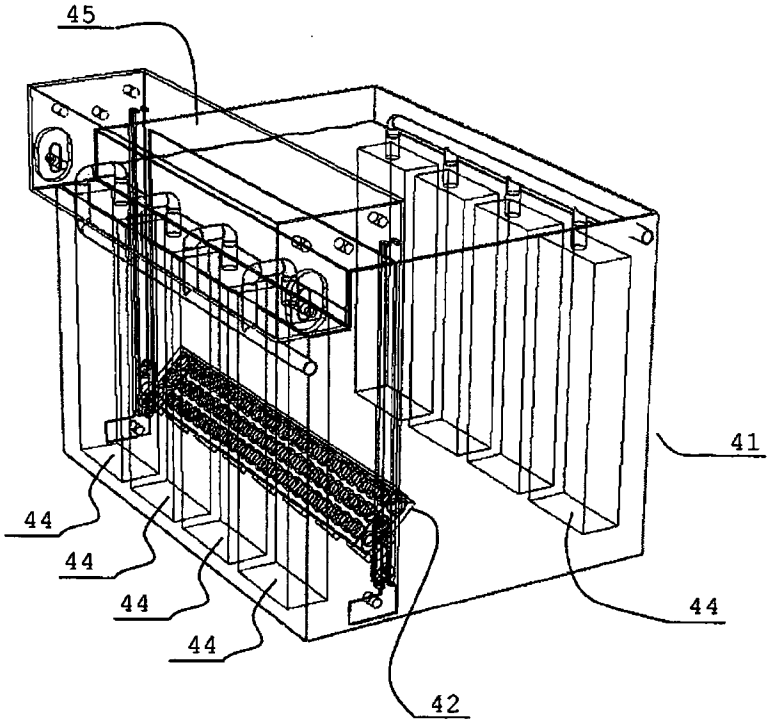

FIG. 19 is an isometric view of the cleansing unit (4) with the receptacle in its lower position but without a filter screen frame (2), and illustrating the motor elevator housing and also the ultrasound panels.

Figure 20:
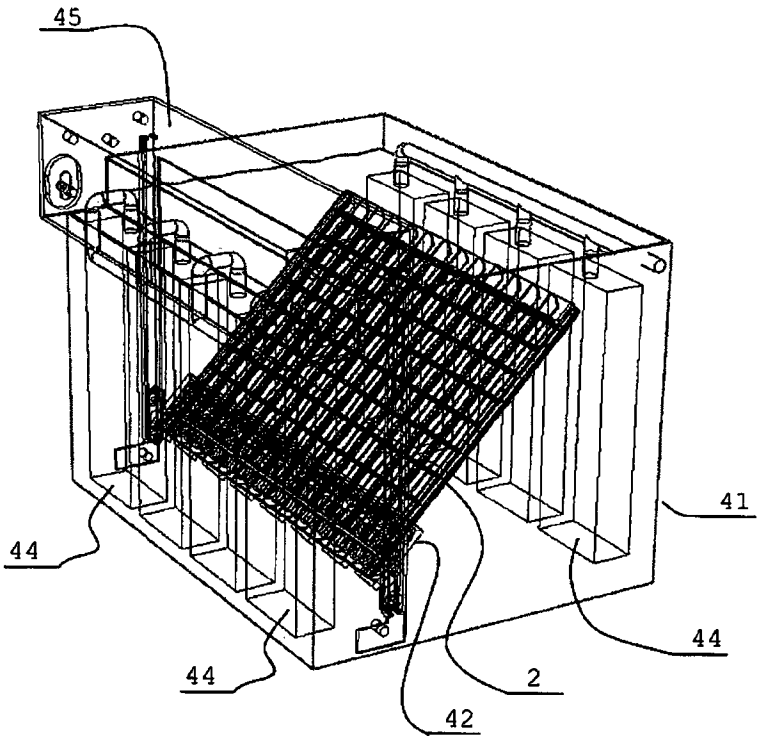

FIG. 20 shows in the same perspective as FIG. 19 a filter screen frame (2) submerged in the bath and held in an inclined position by the of the cleansing unit (4).

Figure 21:
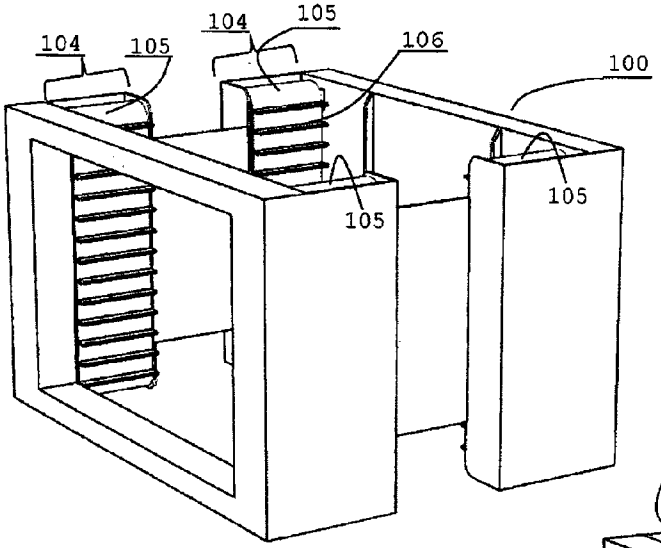

FIG. 21 is an isometric view of the magazine unit (100) with the two double sets of vertical elevator conveyor belts with slots formed by horizontal ribs ( ) on the conveyor belts. The conveyor belts may thus receive filter screen frames (2) horizontally through the main port and the main manipulator unit may lay down filter screen frames (2), usually cleaned, dry and repaired, on the upper set of ribs and the same manipulator unit may pick a filter screen frame (2), usually contaminated and dripping of mud, from the lower slot formed by the two lower sets of ribs at any time.

Figure 22:
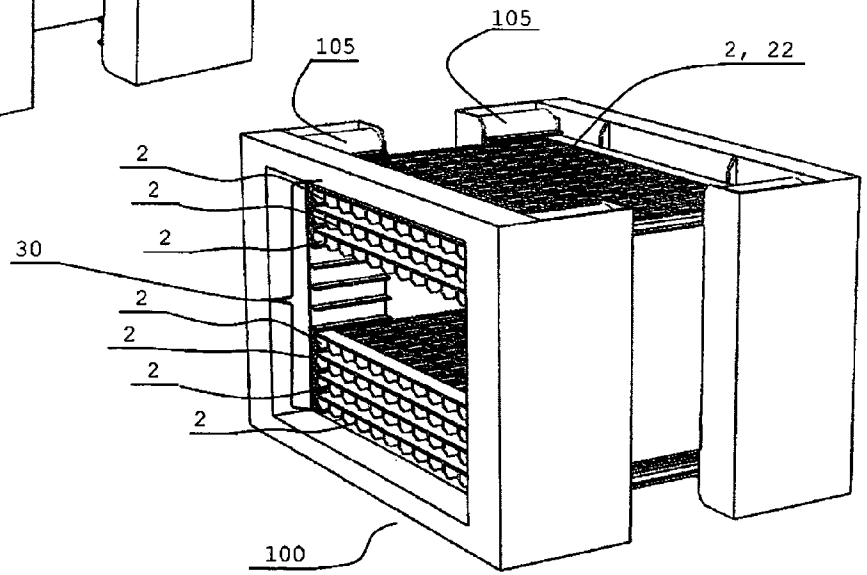

FIG. 22 illustrates in the same perspective the magazine (100) with several filter screen frames (2).

Figure 23:
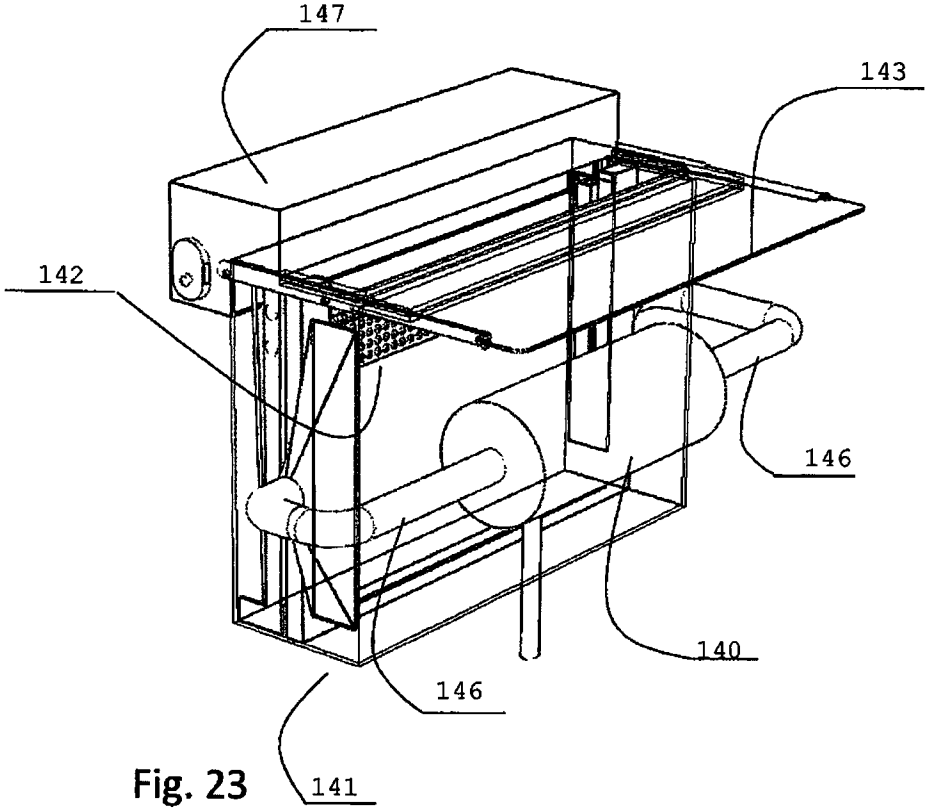

FIG. 23 is an isometric view of the dryer unit (140) shown partly transparent, with the dryer cabinet and the air pump and air piping and shows part of the internal dryer elevator unit with the dryer frame receptacle.

Figure 24:
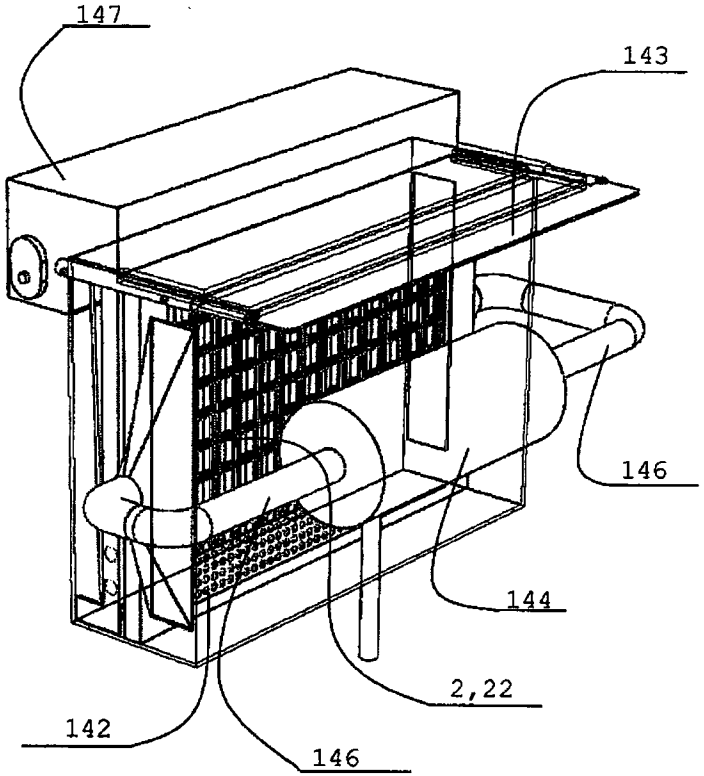

FIG. 24 shows, in the same isometric view of the dryer unit (140), with an inserted filter screen frame (2).

Figure 25:
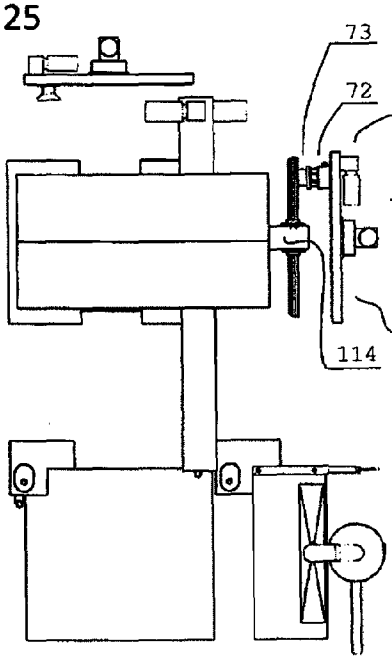

FIG. 25 is a lateral elevation view of the apparatus interior according to the invention in which the repair manipulator head ( ) of the repair station (70) is shown in a position having engaged with a cell filter ( ) in a filter screen frame (2), such as shown in an enlarged view in FIG. 27 below.

Figure 26:
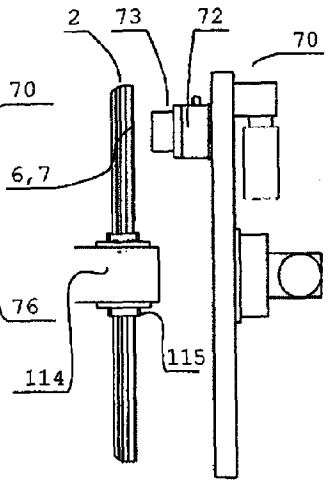

FIG. 26 shows the main manipulator arm (115) holding a filter screen frame (2) in a vertical posture so as for being navigable by the repair manipulator ( ) running on its separate coordinate table in the vertical and transverse horizontal direction of the apparatus. This situation of preparing for repair of the filter screen frame (2) will arise after the frame (2) has been inspected in detail in the optical inspection station (120).

Figure 27:
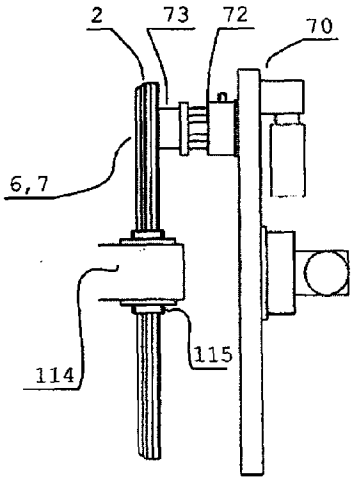

FIG. 27 is a lateral elevation view of the repair manipulator of the repair station (70) having engaged with a particular cell filter in the filter screen frame (2), ready to remove it from the particular cell frame (22).

Figure 28:
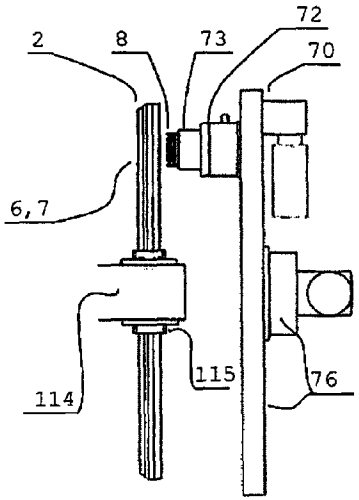

FIG. 28 shows the repair manipulator having engaged with the cell filter and having pulled it out of the particular cell frame (22) of the filter screen frame (22).

Figure 29:
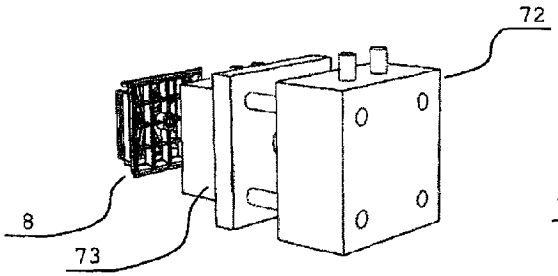

FIG. 29 is an isometric view of the repair manipulator head in position for approaching the screen cloth (1) face of an isolated filter cell according to an embodiment of the invention.

Figure 30:
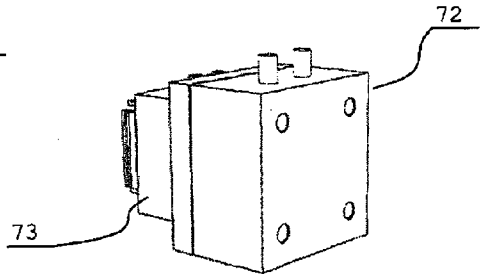

FIG. 30 shows another view of the repair manipulator head engaged with a filter cell.

Figure 31:
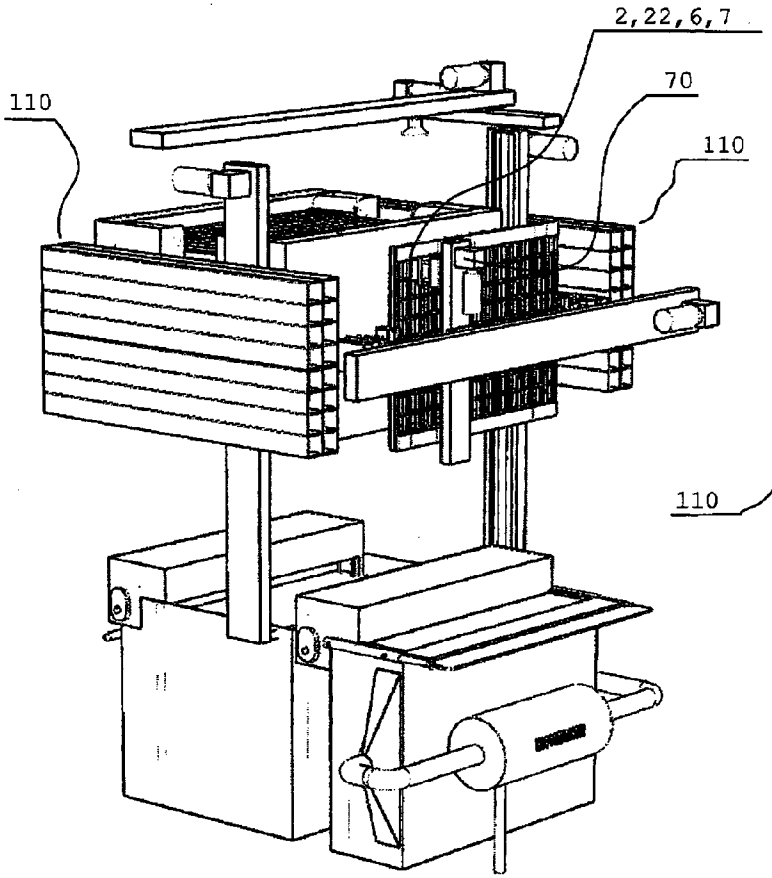

FIG. 31 is an isometric view showing the repair manipulator (72) with the repair manipulator head (72) engaged with a desired cell filter (8) in a position (7) on the filter screen frame (2) determined by the image analysis software of the computer.

Figure 32:
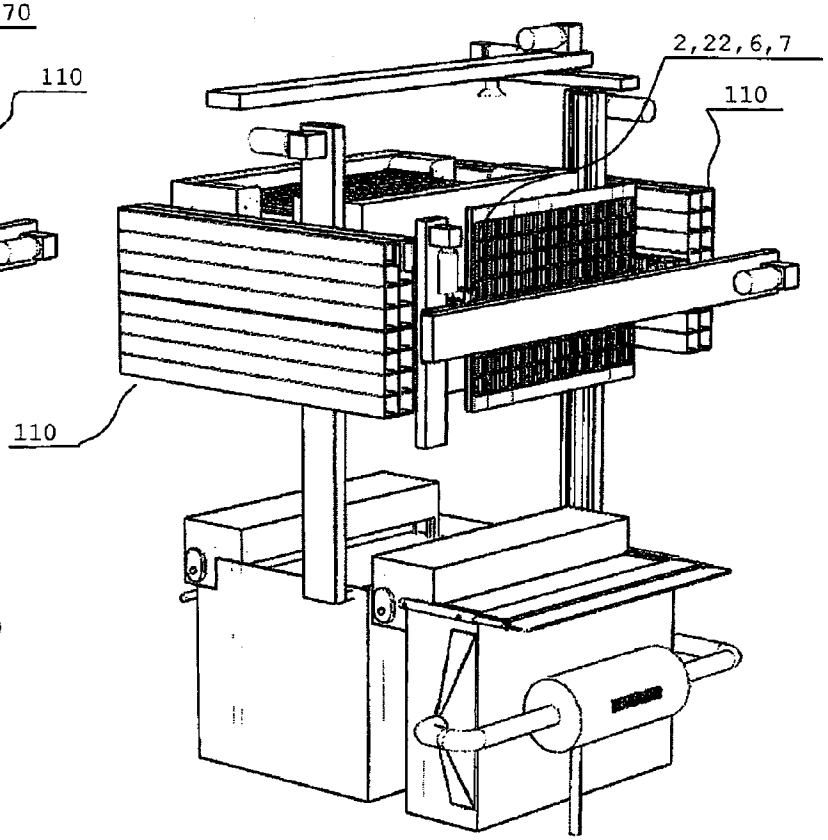

FIG. 32 is the same isometric perspective showing the repair manipulator head (73) parking the so removed filter cell (8) in a free slot in the filter cell magazine (110).

Figure 33:
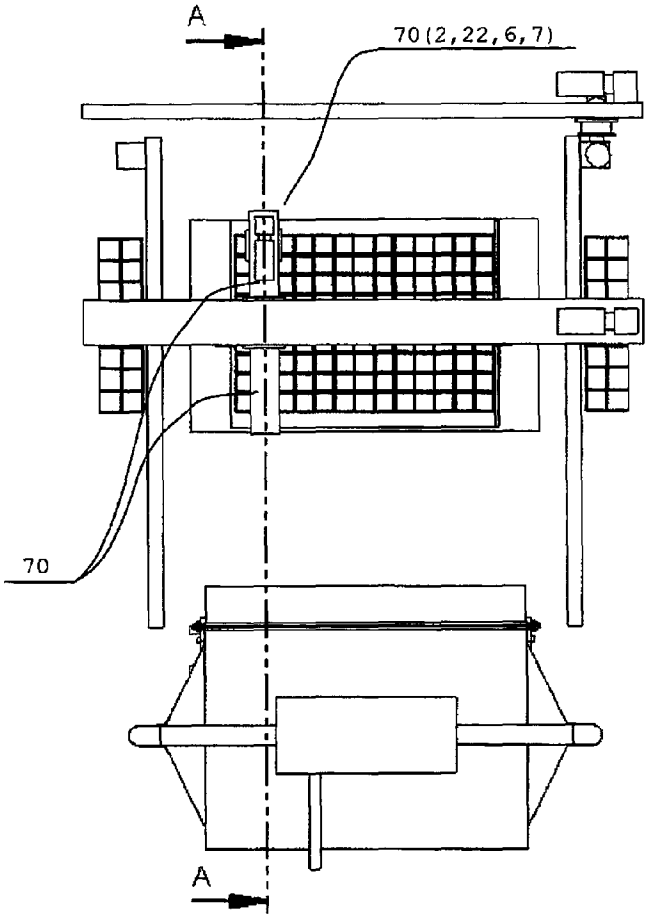

FIG. 33 is an elevation view of the repair manipulator in position corresponding to the situation in FIG. 31. A section plane is indicated for the section shown in subsequent FIG. 34.

Figure 34:
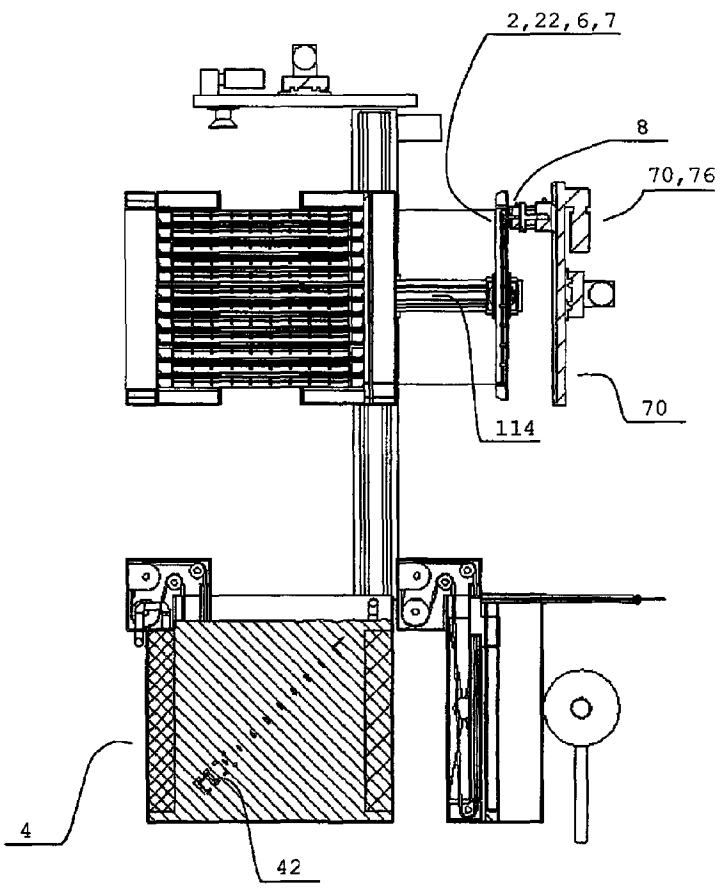

FIG. 34 is the section along the plane shown in the previous FIG. 33. The repair manipulator head is about to extract a filter cell from the filter screen frame (2).

Figure 35:
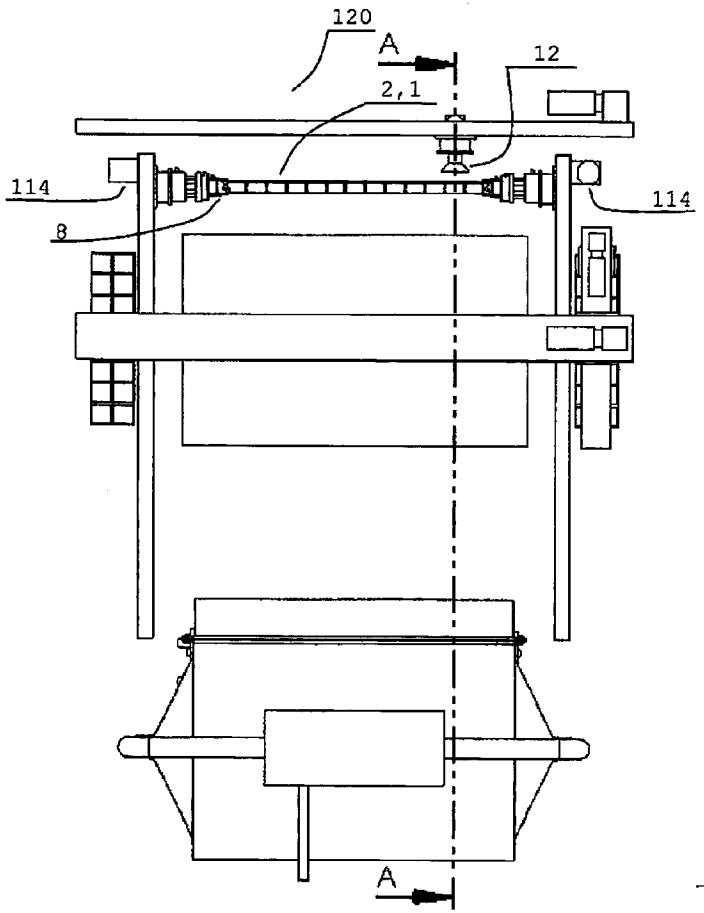

FIG. 35 illustrates in a rear elevation view of the apparatus according to an embodiment of the invention, the filter screen frame (2) moved up into position for being scanned in the optical inspection station (120). A section plane is indicated for the section shown in FIG. 36.

Figure 36:
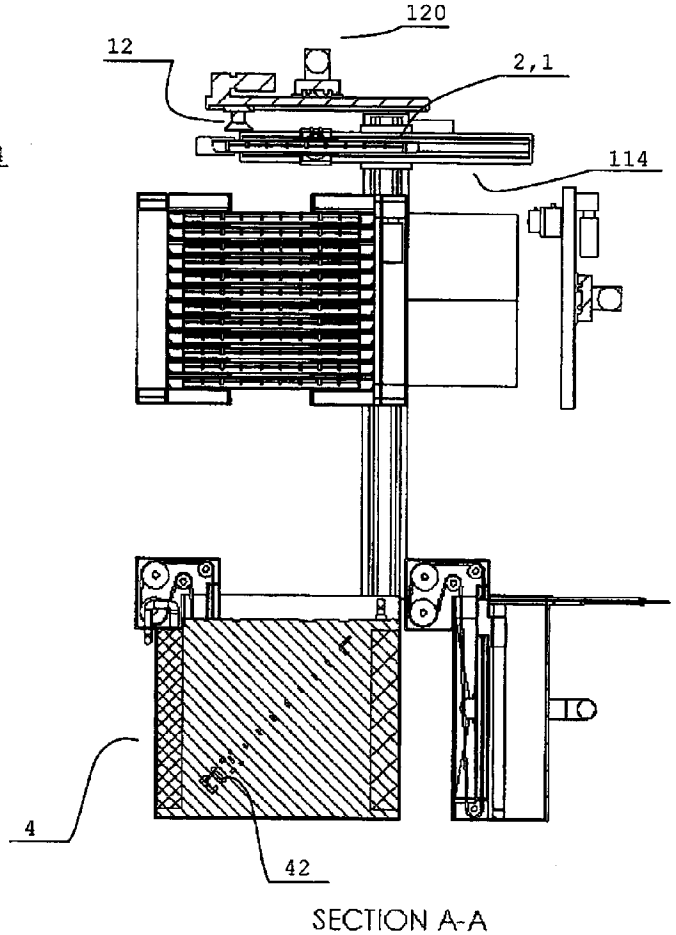

FIG. 36 shows the section with the filter screen frame (2) moved up into position for being scanned in the optical inspection station (120).

Figure 37B:
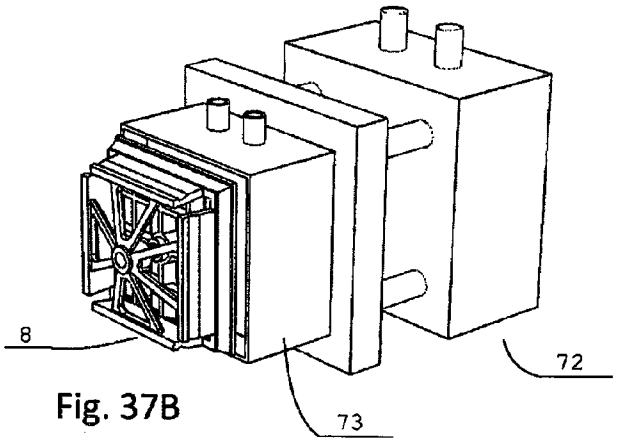
Figure 37A:
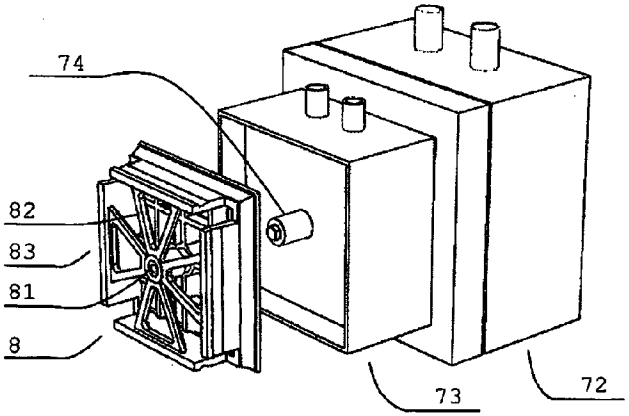

FIG. 37A shows in isometric view the repair manipulator (72) with the repair manipulator head (73) with its centrally arranged key (74) aligned with a filter cell (8).

FIG. 37B shows in a similar isometric view the repair manipulator (72) with the repair manipulator head (73), here in an extended position moved by an actuator in the repair manipulator device (72), engaged with the filter cell (8).

Figure 37C:
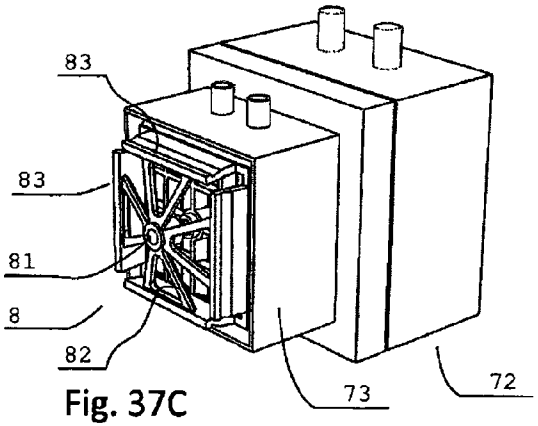

FIG. 37C further shows in a similar view the repair manipulator (72) with the repair manipulator head (73) engaged with the filter cell (8) having been retracted back towards the repair manipulator (72).

Figure 38B:
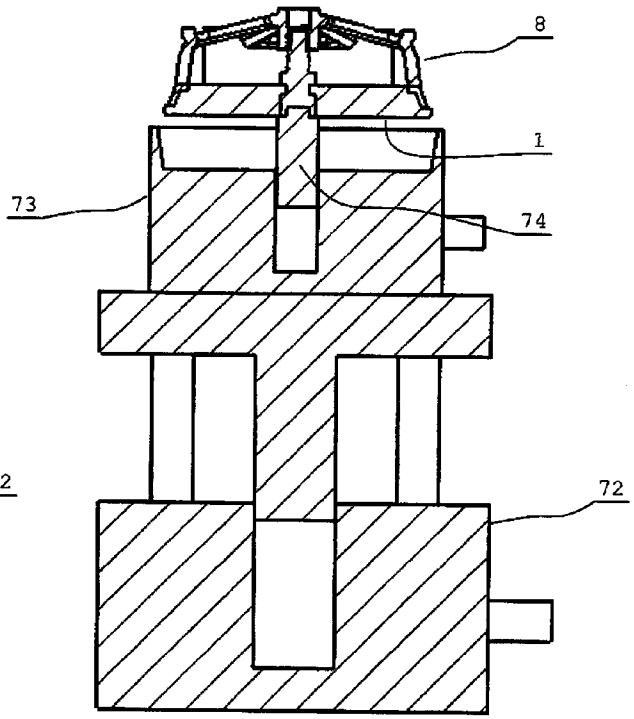
Figure 38A:
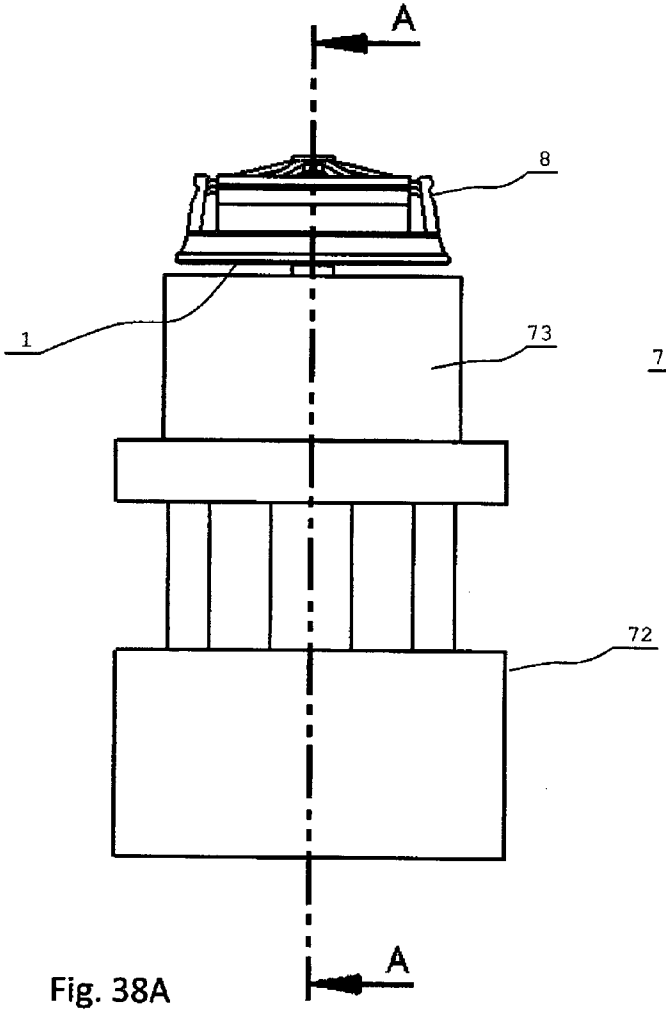

FIG. 38A illustrates a top view of the repair manipulator (72) with the repair manipulator head (73) in an extended position and engaged with a cell filter (8).

FIG. 38B is a section view of the same showing the central key (74) in engaged position in the central lock screw (81) so as for opening the lock mechanism of the filter cell (8).

DESCRIPTION OF EMBODIMENTS OF THE INVENTION

The invention comprises an apparatus for cleansing screen cloths (1) and monitoring wear of such screen cloths (1), comprising:

A magazine (100) is arranged for feeding in used or contaminated screen cloths (1), particularly on screen cloth frames (2) to a cleansing unit (4). The screen cloths (1) are usually made of steel mesh but may be made in other materials such as composite fibre cloths. The feeding unit may comprise actuators (115), sheaves and guide rails arranged for displacing and guiding frames (2) with screen cloths (1) from the magazine (100) to the cleansing unit (4). The cleansing unit is arranged for receiving and cleansing the screen cloth (1). The aparatus comprises a dryer or unit (140), preferably an air blower dryer, arranged for preparing the screen cloth (1) for optical inspection in an optical station (120) described below. The dryer may comprise a fan, a pump, or a pressurized-air nozzle arranged for blowing air onto the screen cloth. Alternatively, the inspection or the photographic image capture may take place with the screen cloth submerged in a tank with transparent liquid so as for avoiding having to dry the screen cloth before the inspection.

The optical inspection station (120) for the screen cloth (1) is automatic. The inspection station is arranged for identifying one or more damaged portions (6) of the screen cloth (1), and registration of one or more of the damaged portions (6) position (7, 7*x*, 7*y*). In an embodiment of the invention the optical inspection station (120) comprises a measurement device (62), preferably a camera (12) connected to a computer with an analysis algorithm, for measuring and registration of the extent and possible degree of damage of one or more of the damaged portions (6). A subsequently arranged repair unit (70) is arranged for patching or mending one or more of the damaged portions (6). The registration of the repaired portions extent may take place by a post check in the optical inspection station (120).

Figure 1:
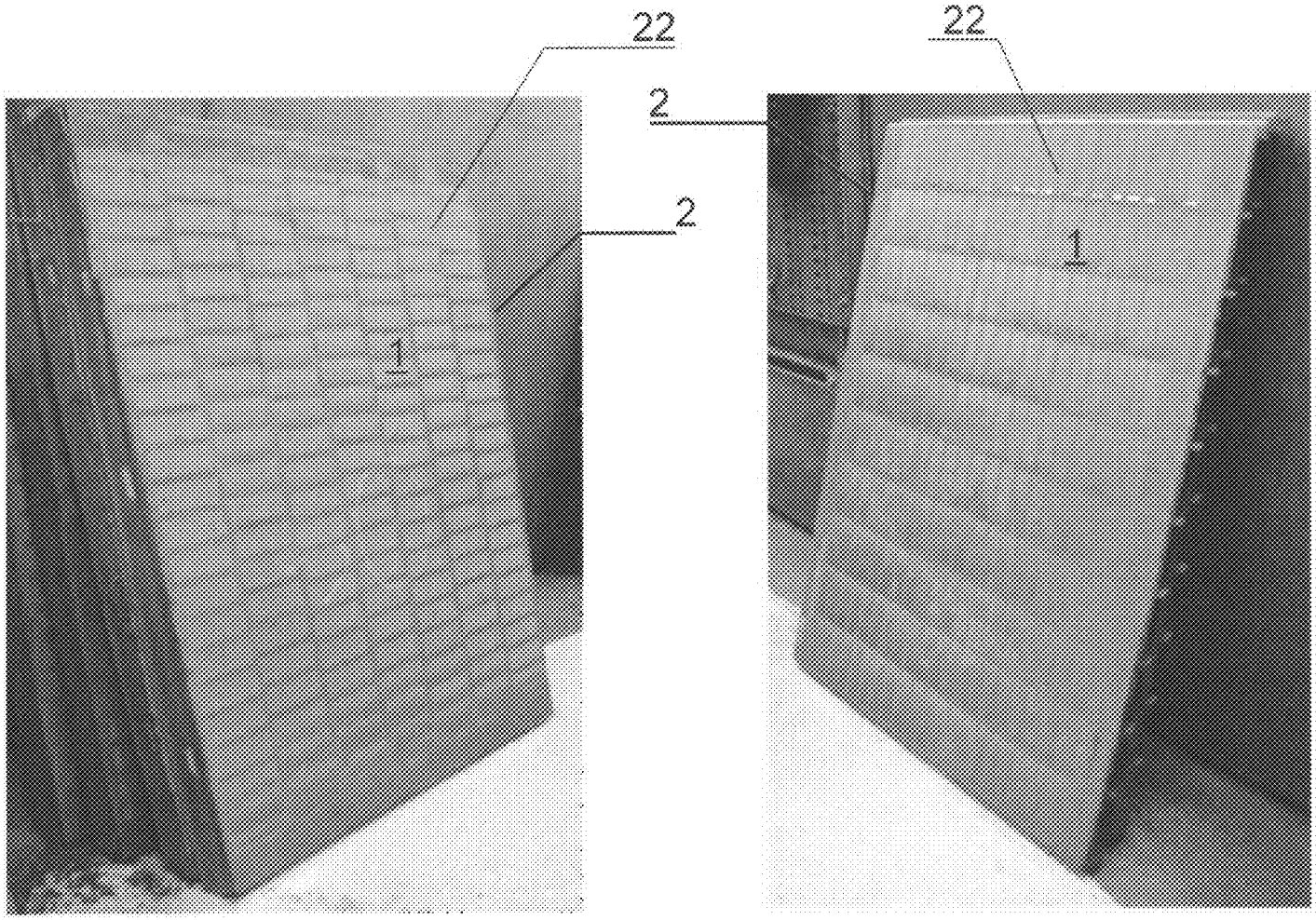
Figure 1B:
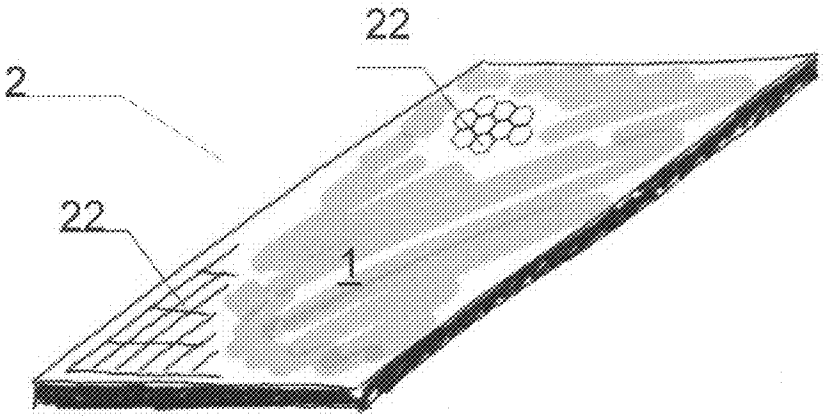
Figure 1C:
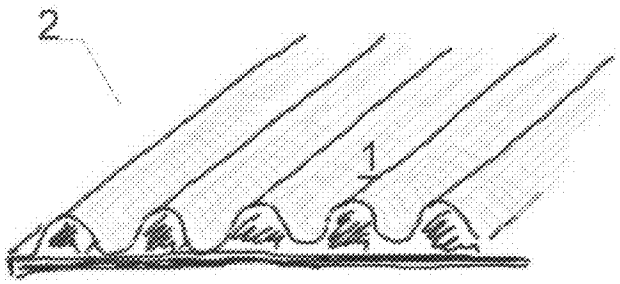
Figure 1E:
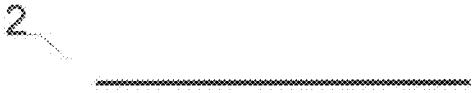
Figure 1F:
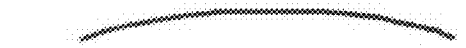
Figure 1G:
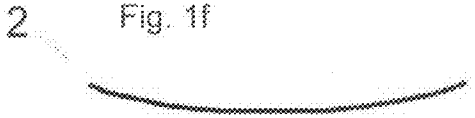
Figure 1H:
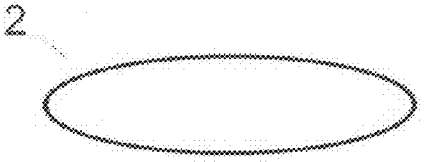
Figure 1D:
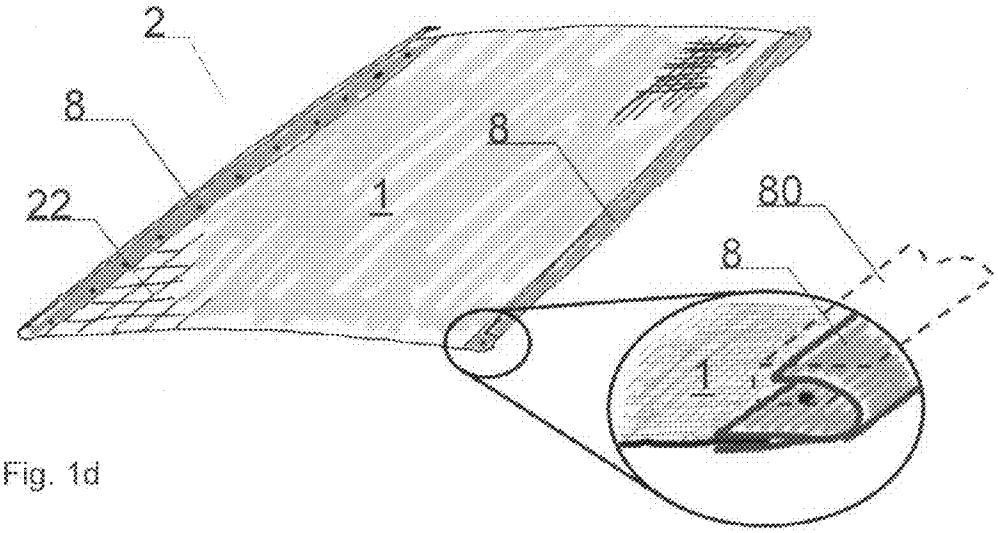

The invention comprises in an embodiment a feeding out gate (102) for feeding out the repaired screen cloth (1) from the repair unit (70), possibly indirectly via the inspection station (120) to a stack station (30) with a stack (3) comprising cleansed, repaired and checked screen cloths (1). In an embodiment of the invention these fed out screen cloths' repaired portions and new properties are registered together with an identifier associated with the screen cloth (1), preferrably in an identifier tag in the frame (2). The screen cloth may also be so-called "frameless", i.e. that the screen cloth (1) may be arranged for being attached in the vibrating shaker apparatus along two or more edges (8), e.g. by so-called "hook strip"-edges, please see FIG. 1*d*, by means of corresponding edge holders (80).

In an embodiment of the method according to the invention the screen cloth (1) is fed in from a stack (30) in a magazine (100) of such screen cloths (1). After cleansing, inspection, registering and repair, the screen cloths are fed out to a stack (30) of such screen cloths (1), preferably to the same stack (30) from which the used, contaminated screen cloths were stored initially. In FIG. 7 the stack of repaired cloths form part of the top of the stack (30) in the magazine (100). In this way the clean, repaired screen cloths (1) will reappear in the same stack which they were stacked into the apparatus. An indicator device in the apparatus may indicate which screen cloths which are useful for further mud filtration and separate those from such screen cloths which should be disposed, by marking or displacing useful screen cloths from disposable screen cloths, or feed out screen cloths to be disposed separately to a separate feed-out stack.

Manual Observation and Measurement

An operator may conduct visual inspection of the screen cloth (1), and conduct a manual measurement of damaged portions' (6) extent and position (7), and register this information. Visual inspection may be good for observing visible damage but may prove insufficient to assess fine damage and wear of the screen cloth due to the high optical resolution required to observe fine mesh screen cloth. The position (7) may comprise two coordinates (7*x*, 7*y*) which are orthogonal. Manual measurement of the one or more damaged portions (6) extent be conducted by means of a so-called hole template (62*m*) such as is illustrated in FIG. 3. Such a hole template is mentioned in SPE103934. The hole template (62*m*) is transparent and comprises a series of consentric circles (or ellipses or rectangles) with given areas, of which said consentric circles are indicated with their respective areas and arranged for being overlaid onto the damage or the open hole (6) and thereby indicates the area of the damaged portion (6) and its status, such as the degree of wear or open hole, and its position (7, 7*x*, 7*y*).

Computer Controlled Observation and Measurement

However, in the present invention the optical inspection station is arranged for photographing cell by cell and analyzes damaged portions' (6) extent and position (7) in an algorithm, and registers this information related to the identified filter screen frame. Such data may then be registered together with the borehole depth or the drilling interval during which the screen cloth (1) has been used, and the identifier of the screen cloth, such that one may monitor the development (or degradation) of the screen cloth (1) during the drilling process. Carriers for such identifiers may be such as an RFID-tag (which is known per se) which may be arranged on the frame (2) or otherwhere in connection with the screen cloth (1), said RFID-tag being arranged for following along with and identify the screen cloth (1) on demand from corresponding RFID-equipment arranged in apparatuses in which the screen cloth (1) passes. Possibly the RFID-tag may store data about the screen cloth (1) and its frame (2) and the condition of the screen cloth (1). One may take the screen cloth (1) out of the critical line of use if its actual cut point or actual particle size distribution no longer satisfies given criteria.

The invention comprises in an embodiment an automatic apparatus as illustrated in FIG. 5 and a further elaborate automated apparatus as shown in FIGS. 6, 7, and onwards, in which the optical inspection station (120) is provided with a digital camera (12) arranged for making image captures (13) of at least one or more of the damaged portions (6) and storing those digital image captures (13) in a camera digital memory (14), and a computer with an algorithm arranged for storing the camera image capture (13) in the memory of the computer. Devices for conducting image captures (13) and storing such in the camera memory (14) and for analysing the image given that one knows she detail structure of what is sought in the image, such as searching for a given range of mesh size in an image and discriminating between a mesh size belonging to a screen cloth (1) and another mesh size belonging to a support cloth (11) and calculating the areal extent of a disclosed area of support cloth (11) and its position (7, 7*x*, 7*y*) is a task for an image analysing engineer; such equipment is known per se.

The camera (12) may be an area camera capturing the entire or part of the area of the screen cloth (1), such as illustrated in FIGS. 35 and 36, or a line camera arranged for scanning line by line of the screen cloth and reconstructs an image of the area of the screen cloth (1) in the camera memory (14) or in an algorithm for reconstructing the image in a computer memory (9). In an embodiment of the invention is used a camera (12) arranged for photographing each filter cell (8) separately. The algorithm for the registration under step (c) with registering of the one or more damaged portion's (6) position and step (e) registering of the one or more damaged portions (6) extent and degree of damage make the calculations in the computer and the registration of the calculated data to the computer memory (9).

The algorithm may generally identify intact screen cloth (1) and cell frame (22) with its cell filter (8), either based on colour, grey tone or even actual optical measurement or image analysis of the image to get hold of the mesh size or wire thickness if the camera resolution is sufficiently high. Departures from intact screen cloth (1) will be a worn screen cloth (1) or an open wear hole, identified e.g. by finding an area and intensity of entirely or partly visible coarse mesh support cloth (11) in or behind the screen cloth (1). The algorithm may work with detecting and calculating the limits of worn portions and wear holes. The apparatus' algorithm for measuring and registering of the one or more damaged portions (6) degree of wear may also be arranged for calculating the degree of damage of the damaged portion (6) and possible broken cloth. The algorithm may further be arranged for calculating the cut point curve or particle size distribution after the repair has been made.

The method according to the invention may in an embodiment comprise measurement of the damaged portion's (6) extent and shape in the form of measuring of the damaged portion's (6) diameter or area, and if required also the shape of the damaged portion's (6) circumference. According to an embodiment of the method with registration of the one or more damaged portion's (6) position (7) and (e) registration of the one or more damaged portion's (6) extent and degree of wear or damage, the measurements will be conducted and sent directly or indirectly to a computer memory (9) for storage. These data may be stored so as for being related to a frame number or other identifier for the frame (2) and real time well data such as the actual drilling depth interval. In an embodiment of the invention these data may be stored using the RFID-equipment above. If a filter cell (8) is to be replaced with a new filter cell (8), no calculation of the size of the damaged portion is required, only the position of the filter cell (8).

The Cleansing Unit

In an embodiment of the invention the apparatuses' cleansing unit such as mentioned under step (b) arranged for cleansing of the screen cloth (1), is provided with a nozzle (43) arranged for flushing cleansing liquid or steam towards at least the upper and preferrably also the lower face of the screen cloth (1) or filter screen frame (2) with screen cloth (1). In practice the drilling liquid which is released from the screen cloths also have to be flushed away from the inner face of the enveloping cleansing station. The cleansing station may be arranged for arranging the screen cloth (1) or filter screen frame (2) in an inclined position, such as illustrated in FIG. 5, during the flushing and cleansing process so as for dirt and remnants of cuttings may run off the screen cloth (1). The apparatus according to the invention is preferrably provided with an ultrasound vibrator (44) arranged for vibrating the screen cloth (1) during the flushing and cleansing process in order to improve the cleansing process. The screen cloth with its frame (1) is designed for operating under vibration in its assigned use for separating drilling mud and cuttings and will thus hardly be further damaged or worn during the ultrasound vibrations of the cleansing process.

As illustrated in FIG. 5 the apparatus according to an embodiment of the invention is arranged so as for the flushing unit (43) comprises at least a rotating beam with flushing nozzles (46) directed at least toward one face of the screen cloth (1), preferrably both sides.

The process according to the invention

According to the invention the process for cleansing, repair and registration of the finally repaired screen cloth (1) for monitoring wear of the screen cloth (1) is conduced by:

a) The apparatus feeds forward a dirty screen cloth (1), preferably from a stack, but alternatively manually from the outside.

b) Feeding in the dirty screen cloth (1) and cleansing of the screen cloth (1) in a cleansing unit (4).

c) Preparing the screen cloth for optical inspection after cleaning, preferrably by drying so as for at least a superficial water film to be removed to a sufficient degree is removed before the optical inspection is conducted.

d) Optical inspection of the screen cloth (1) is conducted in the optical inspection station (120) for identifying one or more damaged portions (6) of the screen cloth (1), and registration of the one or more damaged portions (6) position (7). This may be conducted by a high-resolution photographic camera. e) Measurement and registration of the one or more damaged portions (6) extend and degree of wear and damage. The measurement may be conducted by analysing the image in a computer using a specialized algorithm for detecting intact screen cloth and discriminating it from worn or absent screen cloth. f) Repair of the one or more damaged portions (6) and registration of the repaired portions (60) extent, also here automatically in the inspection station (120). In the inspection station the inspection may check that all required repair actually has been conducted and that the repaired area or areas (60) actually coincide with the positions (7) of the damaged portions (6). Under this step the analysing algorithm may verify that the repair has been conducted with a proper result, and may on the basis of the repairs and the remaining intact cells with intact screen cloth (1) calculate new cut point parameters or particle size distribution for the cleansed, worn and possibly repaired screen cloth (1) for the entire filter screen frame (2). Important here may be to calculate the new and possibly reduced volume capacity of the entire filter screen frame (2) as one may have replaced damaged screen cloth (1) of one mesh with another screen cloth (1) of different mesh, affecting both cut point and PSD for the entire filter screen frame (2).

g) Feeding out the cleansed, inspected and possibly repaired screen cloth (1). Preferrably the screen cloth (1) is fed out to a stack (30) comprising filter screens cleansed and ready for further use. A combined feeding in transport gate (102) and feeding out transport gate (102) to and from the stack (30) may be arranged for feeding in screen cloths (1) one by one. The stack (30) may receive the cleansed, inspected and possibly repaired screen cloths (1) back to available free slots in the stack (30) in the magazine (100).

In an embodiment of the method according to the invention one may during one or more steps (f) with repairing one or more of the damaged portions (6) and registering of the repaired portions (60) patched or otherwise repaired or replaced areas, as the patch may comprise screen cloth, measure and register the area of the repaired portions (60) patched or replaced area (both from the current process and from previous repair processes conducted on the same screen cloth (1) or filter screen frame (2), and thus calculate the remaining, intact proportion of the screen cloth (1). If, as in an embodiment of the invention, replacement screen plugs are used for replacing damaged portions of the screen cloth (1) of the filter screen frame (2), the entire area remains complete after repair. When these data are registered together with the screen cloth's (1) or filter screen frame's (2) frame number or other identifyer, together with the actual drilling depth interval drilled, lithology, etc., obtain an insight into the screen cloth's (1) drilling history and development of its properties such as cut point and PSD over time, and may relate those to the drilling progress. The operator may further have an indication to how long the shaker screen may last during its use in the separator during the drilling process. Based on this information and the history of comparable screen cloths (1) or filter screen frames (2) the operator will obtain good indication to how long the screen cloth may last and at what point of run-time it should be taken out of use for a new general repair or scrapping. The method may during step (f) with registration of the repaired portions (60) extent register real-time data from the drilling process, such as in which time interval the damage (6) occurred, or which drilling depths in the well that the screen cloth (1) has been used when the damage occurred, the circulation rate, the rotational speed for the drill string, the weight on bit, and the rock type. As such the method of the present invention may provide valuable data for higher order drilling monitor processes on the drilling platform so as for enhancing the drilling progress.

In the method according to the invention it may be advantageous, for the step of measuring and registering the repaired portions (60) state and extent, to transfer the screen cloth (1) to the optical inspection station (120) such as indicated in FIG. 4 and FIG. 5.

The apparatus according to the invention is, in other words, an industrial washing machine for relatively fine mesh screen cloths (1) used for separating drill cuttings from drilling liquid or drilling mud during a well drilling process. The drilling process may use rather low density drilling slurry-like liquids such as early after setting the riser and the BOP, or higher density drilling liquids such as used when high well pressure may be encountered. The machine according to the invention is arranged for washing and drying screen cloths (1), for inspecting for wear and damage, for repairing possible damages or holes, for inspecting the screen cloth after possible repairs, and in an embodiment for storing the repair data and relate those data to the identifier of the screen cloth's frame number and the actual drilling depth interval of use, and for returning the cleansed, possibly repaired screen cloth for further use.

Thus the apparatus and the method according to the invention may contribute not only to clean screen cloths used in the drilling process, but also for detecting wear and damage at a given time during the drilling process, measure the extent of the damage, repair the damage to an acceptable degree before the extent of the damage may increase to an undesired degree or in an uncontrolled manner, and possibly take out shaker screens which no longer may contain or separate the drilling liquid in a proper way. During drilling processes using screen cloths in the way used in industry practice a rough estimate of the duration of a shaker screen may be about 3 m3 theroretically drilled well volume per shaker screen before it has been afflicted 20% damage or reduction of its capacity.

In a drilling process which has been conducted using a manual experimental embodiment of the method according to the invention, in which systematic observation, measurement and registration of wear and open holes of the screen cloths have been conducted, and in which open holes have been repaired, and in which an account has been made over the screen cloths' remaining intact area, the duration of a number of 25 applied screen cloths have been increased to about 1200 m3 filtered, theroretically drilled out well volume per shaker screen frame, and no screen frames had to be disposed of. In this way the invention to a large degree solves the problems of the background art related to wear and damages to screen cloths, and contributes significantly to reduction in the consumption of screen cloths during drilling petroleum wells. The method and the apparatus according to the invention contributes to actually register the real conditions related to the actual cut point and PSD for the controlled and repaired screen cloths and thus the quality of the primary separation, which in the background art is not actually taken care of. Indirectly the apparatus and the method of the invention reduces the wear of the shaker screen and may thus contribute to improve the drilling progress and increase the degree of predictability to complete the predefined drilling schedule within a given time and budget.

FIG. 4 is a rough illustration of the general process according to the invention for feeding in used, mud contaminated screen cloth frames (1, 2), cleansing the screen cloth, inspecting the screen cloth for wear and possible damages, registering the damages and the wear state of the screen cloth, repairing registered damages of the screen cloth, checking and verifying the repairs, and feeding out the intact or repaired, registered screen cloth frame (1, 2). Repair may be conducted by exchanging part of damaged screen cloth with new screen cloth in part of or entire cell frames (22).

In FIG. 5, which is a rough overview of an embodiment of the apparatus of the invention for feeding, cleansing, inspecting, registering, repairing, controlling and feeding out of screen cloths (1). In FIG. 6 is shown an embodiment of the invention showing the apparatus' cabinet (101) with a front feeding gate (102) to the magazine for shaker screens, and vertical slots (111) to the sides of the front feeding gate, said slots (111) leading in and out of screen plug magazines (110) for new and used screen plugs (8) used during repair of shaker screens (2).

In FIG. 7, is shown the magazine main stack 3 for shaker screen frames (2), a cleansing unit (4), an air dryer unit (140) for preparing the shaker screen frame for inspection, an optical inspection station (120) on top, and a shaker screen repair unit (70) at the rear part of the apparatus of the invention.

In FIG. 8 is illustrated the path of the shaker screen frame through the entire apparatus. Further is illustrated a computer with a computer memory (9) and an algorithm for analyzing screen images (13) received from camera memory (14).

In FIG. 9B the section indicated in FIG. 9A is shown with an elevator conveyor belt (105) to either sides of the magazine and with shaker screen frames (2) arranged horizontally and hanging in slots formed by horizontal transverse ribs (106) on the elevator conveyor belts (105). To the right and left side of the magazine (100) are arranged vertical arrays in screen plug magazines (110) for new and used filter plugs (8) for the shaker screens (2). Further, in the right portion of FIG. 9B is shown a repair manipulator element (72) in position for entering or catching a filter screen plug (8) at the screen plug magazine (110).

FIG. 10A shows a side view illustration of the apparatus with a section plane through the middle of the magazine (110), between the elevator conveyor belts (105). FIG. 10B is a section view of the section indicated in FIG. 10A showing the main manipulator element (115) in level with the lower of the stacked shaker screen frames (2) and in position to be displaced horizontally to grip that lower shaker screen frame.

FIG. 11 is a side elevation simplified view of the apparatus of an embodiment of the invention, indicating a vertical section through the fore elevator belts and a forward part of the bath of the cleansing unit (4).

FIG. 12 is the section indicated in FIG. 11. Here, the elevator conveyor belt (105) in the main magazine (100) and the screen plug magazines (110) are shown in the upper part. In the lower part of FIG. 12 is shown a section through the cleansing unit's (4) motor housing arrangement for the receptacle (42), in which said motor is arranged above the bath's liquid level in order to protect the motor. Vertical ultrasound transducer transducer (44) panels are arranged in a number of four at either end surfaces of the liquid tank (41). The ultrasound transducers (44) will generate an ultrasound wave field which will agitate particles trapped on the filter screen cloth (1) on the filter screen frame (2) or on filter screen plugs (8), depending on whether a traditional or novel type of filter screen frame adapted for such filter screen plugs (8), is used.

FIG. 13 is a side elevation simplified view of the apparatus of an embodiment similar to FIG. 11 but with the section plane made vertically between the conveyor belts (105) of the elevator (104).

FIG. 14 shows the section indicated in FIG. 13 wherein is illustrated in the upper part of the section the main manipulator elements (115) extended onto the lower shaker screen frame (2) of the magazine (100). The manipulator element is arranged on a laterally arranged pair of coordinate controlled conveyor boards (114) arranged for moving the main manipulator elements on a rotatable and laterally movable actuator (116) between and through the main magazine (100), down to the cleansing station (4), to the drying or "preparation" station (140), further to the optical inspection station (120), to the repair station (70), and back to the magazine (100). Thus the manipulator element (115) is ready to move the shaker screen frame down to the receptacle of the cleansing unit. In the lower portion of the section of FIG. 14 is shown the receptacle in a position above the liquid of the bath, a reception position which will prevent the manipulator element from being submerged in the bath. This will prevent corrosion or shorting of conductors, actuator elements and motors of the manipulator element.

FIG. 15 is an isometric view of the apparatus showing the situation in which the main manipulator elements (115) are about to deliver the shaker screen frame (2) to the receptacle (42) of the cleansing unit (4).

FIG. 16 is a part isometric view in the same perspective as FIG. 15, part isometric vertical section through the magazine (100), the cleansing unit (4) with the submerged shaker screen frame (2) subject to ultrasound cleansing from the submerged ultrasound elements (44), and also a section through the drying unit's (140) dryer cabinet with the vertically displaceable dryer receptacle (142) in an upper position ready for receiving the cleansed shaker screen frame (2) when finished in the cleansing bath and forwarded by the cleansing unit's elevator receptacle (42) in cooperation with the main manipulator elements (115). A lid (143) on the dryer cabinet (141) is shown in the open position. The lid (143) is important for two reasons: firstly, with the shaker screen frame inserted and lowered, and enveloped by gaskets (not shown) from the inner faces of the walls of the dryer cabinet (141) the air will enter through the shown drying air pipe inlet from the pump (144) to a first surface side of the wet shaker screen frame, and pass through the entire shaker screen's (2) total area of screen cloth (1) to the opposite side, wherefrom the now wet air will leave through a humid air outlet pipe. The humid air as such may be ejected to the environment or recycled through a combined air dryer and pump unit (144).

FIG. 17 is an isometric view showing the side and rear parts of an embodiment of the invention, in the lower rear part is shown the dryer unit (140) with the air pump (144) and air piping to and from the drying cabinet (141). The lid (143) is open and the main manipulator unit (115) is about to lower the shaker screen frame (2) down into the vertically running frame receptacle (142) of the drying cabinet (141). Above the drying unit is shown the rear of the repair unit (70) with the mobile repair manipulator (72) in a laterally displaced position behind the screen plug magazine (110) in order to allow for free movement of the shaker screen frame (2).

FIG. 18 illustrates the subsequent situation in which the manipulator unit (72) has released from the shaker screen frame (2), the dryer unit's frame receptacle (142) with the shaker screen frame (2) has been lowered into the drying cabinet (141), and the lid (142) is closing. In this way, the closed lid will ensure recycling of the humid air, and will prevent humidity from blowing from the drying cabinet (141) and up into the entire interior of the apparatus, particularly avoiding humidity from reaching the optical inspection station (120) with the camera (12).

FIG. 19 is an isometric view of the cleansing unit (4) with the receptacle (42) in its lower position but without a shaker screen frame (2), and illustrating the motor elevator housing (45) and also the ultrasound panels ( ).

FIG. 20 shows in the same perspective as FIG. 19 a shaker screen frame (2) submerged in the bath and held in an inclined position by the of the cleansing unit (4). In this posture with the shaker screen cloth facing up in an inclined angle, and with the cell frame (22) structure apertures of the filter screen frame (2) facing downwards, no particles should be trapped permanently on or in the shaker screen frame.

FIG. 21 is an isometric view of the magazine unit (100) with the two double sets of vertical elevator conveyor belts (105) with slots formed by horizontal ribs (106) on the conveyor belts (105). The conveyor belts (105) may thus receive shaker screen frames (2) horizontally through the main gate (102) and the main manipulator unit (115) may lay down shaker screen frames (2), usually cleaned, dry and repaired, on the upper set of ribs (106) and the same manipulator unit may pick a shaker screen frame (2), usually contaminated and dripping of mud, from the lower slot formed by the two lower sets of ribs (106) at any time. Thus the upper, clean frames (2) will not be polluted by dripping from the lower, contaminated frames (2). The conveyor belts run via upper and lower rollers by means of a motor and may be controlled from the central computer unit to cooperate with the main manipulator unit. All operations such as for moving parts of the apparatus may be controlled from the computer unit.

FIG. 22 illustrates in the same perspective the magazine (100) with several shaker screen frames (2). The shaker screen frames will abut against the back wall of the cabinet of the magazine (100) in order to prevent any of the frames (2) in the stack (3) in the magazine (100) to interfere with the main manipulator transport of cleaned frames (2) and the repair station (70) behind the back wall.

FIG. 23 is an isometric view of the dryer unit (140) shown partly transparent, with the dryer cabinet (141) and the air pump (144) and air piping (146) and shows part of the internal dryer elevator unit with the dryer frame receptacle (142), which is driven by an external motor in a motor housing (147) arranged with chain or wire or belts to lower and raise the receptacle (142).

FIG. 24 shows, in the same isometric view of the dryer unit (140), with an inserted shaker screen frame (2) forming a permeable wall between the fore and aft so formed compartment of the dryer unit (140), forcing the air to pass through the combined area of the entire screen cloth (1) area of the shaker screen frame (2). This full width blow-through will improve the drying capacity as compared to blowing air past the upper and lower face of the shaker screen frame.

FIG. 25 is a lateral elevation view of the apparatus interior according to the invention in which the repair manipulator head(73) of the repair station (70) is shown in a position having engaged with a cell filter (8) in a shaker screen frame (2), such as shown in an enlarged view in FIG. 27 below.

FIG. 26 shows the main manipulator arm (115) holding a shaker screen frame (2) in a vertical posture so as for being navigable by the repair manipulator (72) running on its separate coordinate table in the vertical and transverse horizontal direction of the apparatus. This situation of preparing for repair of the shaker screen frame (2) will arise after the frame (2) has been inspected in detail in the optical inspection station (120) and the images (13) from the camera memory (14) have been run through the image analysis algorithm in the computer. The repair manipulator head (73) is thus moved to a commanded position (7, 7*x*, 7*y*) for repairing a filter cell (8) by exchanging the filter cell by a new or at least sufficiently good used filter cell (8).

FIG. 27 is a lateral elevation view of the repair manipulator head (73) of the repair station (70) having engaged with a particular cell filter (8) in the shaker screen frame (2), ready to remove it by unlocking and extracting it from the particular cell frame (22).

FIG. 28 shows the repair manipulator having engaged with the cell filter (8) and having pulled it out of the particular cell frame (22) of. the shaker screen frame (2).

FIGS. 26, 27, and 28, which are explained with regard to engaging and removing a filter cell (8) may of course illustrate the opposite operations of holding a new filter cell (8), inserting into the frame (22) and locking and disconnecting the repair manipulator head (73) from the new and inserted filter cell (8).

FIG. 29 is an isometric view of the repair manipulator head (73) approaching the screen cloth (1) face of an isolated filter cell (8) according to an embodiment of the invention.

FIG. 30 shows another view of a repair manipulator head (73). The manipulator head (73) is provided with a movable central protruding key (74), please see FIG. 37A, arranged for engaging with a corresponding lock screw centrally arranged on the screen cloth face (1) of the preferred type of filter cell (8) according to the invention.

FIG. 31 is an isometric view showing the repair manipulator (72) with the repair manipulator head (73) engaged with a desired cell filter (8) in a position (7) on the shaker screen frame (2) determined by the image analysis software of the computer after images (14) have been registered in the optical inspection station (120) and stored in the memory (9).

FIG. 32 is the same isometric perspective showing the repair manipulator head (73) parking the so removed filter cell (8) in a free slot in the filter cell magazine (110). For improving operational speed of the repair manipulator (72), which moves on a coordinate board (76) similar to the main coordinate board (114) one lateral part of each laterally arranged filter cell magazine may be used for parking removed filter cells (8), and the immediately opposite adjacent part of the filter cell magazine (110) may be provided with "fresh" new or sufficiently good clean filter cells (8). Such a repair of the shaker screen frame (2) according to an embodiment of the invention may prove far faster than the conventional silicon pasting technique used, while maintaining full total screen cloth area of the screen frame (2).

FIG. 33 is an elevation view of the repair manipulator (72) in position corresponding to the situation in FIG. 31. A section plane is indicated for the section shown in subsequent FIG. 34.

FIG. 34 is the section along the plane shown in the previous FIG. 33. The repair manipulator head (73) is about to extract a filter cell from the shaker screen frame (2). A further feature of the invention is shown in the lower part of the section: while one cleansed, dried and image-analyzed shaker screen frame (2) is being repaired in the repair station (70), or even during the photographing step, a next screen frame (2) may be picked from the bottom of the stack (30) and led into the cleansing station (4); the screen frames will not interfere. While the screen frame (2) is being ultrasound cleansed in the bath the repair station may finish its task and the main manipulator (115) may move the finished repaired screen (2) to the top of the stack before moving the next, cleansed screen frame to the dryer unit.

The apparatus may in one embodiment be arranged for, subsequent to the work process conducted in the repair station (70), returning the repaired or modified shaker screen frame (2) to the optical inspection station (120) for conducting a verification of the repairs or modifications, such as checking whether the repair actually has been made, or checking that the screen plugs have been inserted fully in place, checking the integrity of the lock screw, and for storing data about the verification to the database. After the verification in the optical inspection station (120) the shaker screen frame (2) may be returned to the top of the stack (30) in the magazine (3).

The repair station may not only exchange damaged filter cells (8) of the shaker screen frame (2). If a desired cut-point configuration is desired in order to reach a predefined particle size distribution (PSD) of a shaker screen (2) due to particular or changing drilling conditions, such as may arise from a change of lithology or in order to obtain desired properties of the drilling mud, the control computer may command the repair manipulator to exchange still useful cell filters (8) of the existing cut point with other cell filters of a different cut point.

Another useful aspect of the invention is the simple fact that the apparatus may be used for building a desired cut point configuration of an empty shaker screen (2) from scratch, starting with an empty screen frame (2) without cell filters (8) mounted initially.

Further, as some particles and mud may remain between the filter plugs (8) and their corresponding cell frames (22) of the shaker screen frame (2), the apparatus according to the invention may be used for cleansing empty screen frames (2) and for imaging them in order to check the integrity of the cell frames (22) ribs using the camera in the optical inspection station. Such inspection may be conducted using electromagnetic sensors mounted on the camera translation frame, or the camera (12) itself.

FIG. 35 illustrates in a rear elevation view of the apparatus according to an embodiment of the invention, the shaker screen frame (2) moved up into position for being scanned in the optical inspection station (120). FIG. 36 shows the section with the shaker screen frame (2) moved up into position for being scanned in the optical inspection station (120).

FIG. 37A shows in isometric view the repair manipulator (72) with the repair manipulator head (73) with its centrally arranged key (74) aligned with a filter cell (8). The centrally arranged key (74) is arranged to interact with the lock screw (or pin) (81) of the filter cell (8) in order to move lock profiles (83) of the cell (8) inwards for releasing or outwards for locking the cell (8) in the cell frame (22) of the shaker screen frame (2). The lock screw (81) is connected via radially extending sprockets (82) to the lock profiles (83). In FIG. 37B it is shown the repair manipulator (72) with the repair manipulator head (73), here in an extended position moved by an actuator in the repair manipulator device (72), engaged with the filter cell (8). Further, in FIG. 37C is shown the repair manipulator (72) with the repair manipulator head (73) engaged with the filter cell (8) having been retracted back towards the repair manipulator (72).

FIG. 38A illustrates a top view of the repair manipulator (72) with the repair manipulator head (73) in an extended position and engaged with a cell filter (8). The manipulator head facing face of the cell filter is provided with one or more layers of filter of a desired mesh, usually of steel.

FIG. 38B is a section view of the same, showing the central key (74) in engaged position in the central lock screw (81) so as for opening the lock mechanism of the filter cell (8). Here the translation mechanism shown is a threaded portion of the lock screw (81) displacing a threaded central sleeve connected to all the sprockets (82) which thus displace the lock profiles (83) in or out of engagement with corresponding profiles of the cell frame (22) of the shaker screen frame (2).

As mentioned above, the apparatus according to the invention may be used for cleansing shaker screen frames (2) without necessary conducting inspection and/or repair.

Vice versa, the apparatus according to the invention may conduct inspection and repair of new or used shaker screen frames. The situation may arise, if one is not sure about the properties such as mesh size of the shaker screen (1) of a shaker screen frame (2), to run it through the optical inspection station (120) in order to analyze the mesh size in the screen cloth (1) in one or more of the cell frames (22).

The invention claimed is:

1. A method for monitoring and maintenance of wear of shale shaker filter screen frames with screen cloths, the method comprising the steps of:

providing a used or drilling liquid contaminated filter screen frame screen cloth to a filter screen frame magazine;

engaging said filter screen frame in said magazine using a movable main manipulator element;

feeding forward said filter screen frame to a cleansing unit and cleansing said filter screen frame with said screen cloth;

moving said filter screen frame to a drying unit using said main manipulator element and drying said filter screen frame;

moving said filter screen frame using said main manipulator element to an optical inspection station and inspecting optically said screen cloth;

using an algorithm in a computer identifying damaged portions of said screen cloth and registering said damage portions' position in a computer memory;

determining in said algorithm said damaged portions' degree of wear or damage and determining whether said worn or damaged portions qualify for being repaired or replaced;

moving said filter screen frame to a repair station with a repair manipulator using said main manipulator element;

replacing said damaged portions qualified for being repaired or replaced by exchanging a screen plug thereof with a replacement screen plug provided in a screen plug magazine by using said repair manipulator;

moving the so repaired filter screen frame back to said magazine, wherein said repair manipulator further comprises a repair manipulator head arranged for engagement with the screen plug.

2. The method according to claim 1, wherein the position of the damaged portions is registered relative to a given origin on the screen cloth or its filter screen frame.

3. The method according to claim 2, wherein said position is registered according to the actual cell frame in said filter screen frame.

4. The method according to claim 1, further comprising the step of using a camera capturing digital images of said filter screen frame in said optical inspection station and analyzing said digital images in an algorithm in a computer, said algorithm at least identifying damaged portions of said screen cloth and registering said damage portions' position in a computer memory, said algorithm further determining whether said worn or damaged portions qualify for the screen cloth comprising said damage portion locally to be replaced.

5. The method of claim 4, wherein said algorithm further comprises determining a degree of wear of said screen cloth.

6. The method of claim 1, wherein said filter screen frame is fed forward from a stack of such screen cloths in said magazine.

7. The method of claim 1, further comprising the step of using one or more ultrasound elements in said cleansing unit cleansing said filter screen frame with said screen cloth.

8. The method of claim 1, further comprising the steps of said repair manipulator moving damaged screen plugs to one or more screen plug magazines and picking replacement screen plugs from said one or more screen plug magazines.

9. The method according to claim 1, further comprising the step of before moving the repaired filter screen frame back to said magazine, moving the repaired filter screen frame to the optical inspection station for verifying and registering the state of the repaired filter screenframe.

10. The method of claim 1, further comprising the step of registering in said computer memory the current drilling depth interval for which said screen cloth was used, and possibly the time of occurrence of said damaged portions.

11. The method of claim 1, further comprising the step of using an algorithm in a computer retrieving said stored image capture and analysing said image capture for said damaged portions' position.

12. The method of claim 1, wherein said registration of said damaged portions extent and degree of damage is made corresponding to an identifier of said filter screen frame in a database in order to contribute to said filter screen frames' history during one or more drilling operations.

13. The method of claim 12, further comprising the step of arranging said identifier in an electronic tag on said filter screen frame.

14. An apparatus for monitoring and maintenance of wear of shale shaker filter screen frames with screen cloths, the apparatus comprising:

a magazine for receiving one or more contaminated filter screen frames;

a cleansing unit;

a drying unit;

an optical inspection station;

a repairing unit;

a movable main manipulator element arranged for engaging said filter screen frame in said magazine, and further arranged for feeding forward said filter screen frame to the cleansing unit, to the drying unit, to the optical inspection station, to the repairing unit and back to said magazine, wherein:

said cleansing unit is arranged for cleansing said filter screen frame with said screen cloth, said drying unit is arranged for receiving said filter screen frame for drying said filter screen frame, said optical inspection station is arranged for receiving said filter screen frame and arranged for optically imaging said screen cloth and using an algorithm in a computer for identifying damaged portions of said screen cloth and for registering said damaged portions' position in a computer memory, and said repair station is arranged for receiving said filter screen frame and provided with a repair manipulator for repairing or replacing said damaged portions qualified for being repaired or replaced with replacement portions of screen cloth;

an algorithm for determining said damaged portions' degree of wear or damage and for determining whether said worn or damaged portions qualify for being repaired or replaced; and a screen plug magazine with one or more replacement screen plugs arranged for replacing said damaged portions for being replaced, wherein said main manipulator element is arranged for moving the repaired filter screen frame back to said magazine, and said repair manipulator further comprises a repair manipulator head arranged for engagement with the screen plug.

15. The apparatus of claim 14, further comprising a camera for capturing digital images of said shaker screen frame in said optical inspection station and for analyzing said captured digital images in an algorithm in a computer, said algorithm for identifying damaged portions of said screen cloth and for registering said damage portions' position in a computer memory, said algorithm further arranged for determining whether said worn or damaged portions qualify for replacement.

16. The apparatus of claim 14, further comprising one or more ultrasound elements in said cleansing unit for being submerged in liquid for cleansing said filter screen frame with said screen cloth.

17. The apparatus of claim 14, wherein said repair manipulator is arranged for moving damaged screen plugs to one or more screen plug magazines and picking replacement screen plugs from said one or more screen plug magazines.

* * * * *